US006143433A

United States Patent [19]

Murata et al.

[11] Patent Number: 6,143,433

[45] Date of Patent: Nov. 7, 2000

[54] ORGANIC ELECTROLUMINESCENT DEVICE AND PROCESS FOR PRODUCING THE SAME

[75] Inventors: Hideyuki Murata; Hideki Hirano, both of Sodegaura, Japan

[73] Assignee: Mitsui Chemicals, Inc., Tokyo, Japan

[21] Appl. No.: 08/526,083

[22] Filed: Sep. 11, 1995

[30] Foreign Application Priority Data

Sep. 14, 1994 [JP] Japan ..... 6-220616
Sep. 19, 1994 [JP] Japan ..... 6-223830

[51] Int. Cl.[7] ..... H05B 33/00; B05D 5/00

[52] U.S. Cl. ..... 428/690; 428/917; 313/504; 313/506; 427/66; 427/70

[58] Field of Search ..... 428/690, 691, 428/917; 313/503–507; 427/66, 70

[56] References Cited

U.S. PATENT DOCUMENTS 5,449,564 9/1995 Nishio et al. ..... 428/690

FOREIGN PATENT DOCUMENTS

| | | |
|---|---|---|
| 0449125 | 10/1991 | European Pat. Off. . |
| 0622975 | 11/1994 | European Pat. Off. . |
| 53-27033 | 3/1978 | Japan . |
| 54-58445 | 5/1979 | Japan . |
| 54-64299 | 5/1979 | Japan . |
| 54-149634 | 11/1979 | Japan . |
| 55-144250 | 11/1980 | Japan . |
| 56-119132 | 9/1981 | Japan . |
| 61-295558 | 12/1986 | Japan . |
| 63-295695 | 12/1988 | Japan . |
| 03141588 | 6/1991 | Japan . |
| 42096 | 1/1992 | Japan . |
| 05152072 | 6/1993 | Japan . |
| 711249 | 1/1995 | Japan . |
| 9531831 | 11/1995 | WIPO . |

OTHER PUBLICATIONS

English–language Abstract of Japanese Publication 53027033 (Mar. 13, 1978).
English–language Abstract of Japanese Publication 54058445 (May 11, 1979).
English–language Abstract of Japanese Publication 54064299 (May 23, 1979).
English–language Abstract of Japanese Publication 54149634 (Nov. 24, 1979).
English–language Abstract of Japanese Publication 55144250 (Nov. 11, 1980).
English–language Abstract of Japanese Publication 56119132 (Sep. 18, 1991).
English–language Abstract of Japanese Publication 61295558 (Dec. 26, 1986).
English–language Abstract of Japanese Publication 63295695 (Dec. 2, 1988).
English–language Abstract of Japanese Publication 4002096 (Jan. 7, 1992).
Tang et al., "Organic Electroluminescent Diodes," *Appl. Phys. Lett.,* vol. 51, No. 12, pp. 913–915, Sep. 21, 1987.
Yamaguchi et al., "New Class of Electron Acceptors Having High Polymer Dispersibility, Unsymmetrically Substituted Diphenoquinones, and Their Application as Electron Transport Materials," *Chem. Mater.,* vol. 3, No. 4, pp. 709–714 (1991). (no month).
Loutfy et al., "Electroded Photoconductivity of Electron Transport Active Matrix," *Journal of Imaging Science,* vol. 29, No. 2, pp. 69–72, Mar./Apr. 1985.
Shirota et al., "Starburst Molecules for Amorphous Molecular Materials," *Chemistry Letters,* pp. 1145–1148 (1989). (no month).
Database WPI, Section Ch, Week 9551, Derwent Publications Ltd., London, GB; Class A26, AN 95–401242, XP002004484 & JP–A–07 278 536, Oct. 24, 1995 *Abstract*.

*Primary Examiner*—Marie Yamnitzky
*Attorney, Agent, or Firm*—Birch, Stewart, Kolasch & Birch, LLP

[57] ABSTRACT

In a first aspect, an organic electroluminescent device having an electroluminescent layer and/or a charge injecting/transporting layer formed out of a thin film of organic polymers of network structure which are excellent in heat resistance and durability, e.g., polyoxadiazoles is obtained by conducting a vapor deposition polymerization of a bifunctional monomer, a polyfunctional monomer of 3 or higher in functionality or a mixture of the polyfunctional monomer and bifunctional monomer and heating the resultant polymer in vacuum or an inert gas. In another aspect, an organic electroluminescent device having an electroluminescent layer and/or a charge injecting/transporting layer formed out of a thin film of polyoxadiazoles is produced without the formation of hydrogen halides (acids) as by-products by performing a vapor deposition polymerization of a monomer having two carboxylic acid halide groups and a monomer having two silylated carbohydrazide groups and heating the resultant polymer in vacuum or an inert gas.

20 Claims, 2 Drawing Sheets

ORGANIC ELECTROLUMINESCENT DEVICE AND PROCESS FOR PRODUCING THE SAME

SPECIFICATION

1. Field of the Invention

The present invention relates to an organic electroluminescent device and a process for producing the same. More particularly, the present invention is concerned with an organic electroluminescent device having an electroluminescent layer and/or a charge injecting/transporting layer formed out of a thin film of organic polymers and a process for producing the same.

2. Background of the Invention

In data display, optical data processing and other fields, recent attention is drawn to organic electroluminescent materials. Any of the organic electroluminescent materials emits light having a wavelength and an intensity characteristic of the material when it is sandwiched between electrodes and a voltage is applied to the electrodes. This light emission is generally believed to result from the injection of electrons and holes from the respective electrodes into the organic electroluminescent material by voltage applied to the electrodes, followed by recombination of the holes and electrons in the organic electroluminescent material. The emitted light has a spectrum nearly identical with a fluorescence spectrum intrinsic to the electroluminescent material.

For example, Appl. Phys. Lett., Vol. 51, No. 12 (1987), pp 913–915 describes a two-layer electroluminescent device (EL device) prepared with the use of organic electroluminescent materials. This two-layer electroluminescent device is prepared by successively forming on an electrode of ITO (indium tin oxide) a hole injecting layer, an electroluminescent layer capable of transporting electrons and an electron injecting electrode of MgAg alloy according to vacuum deposition. When a voltage of tens of Volts is applied to this electroluminescent device, electrons and holes are injected into the electroluminescent layer of the device to thereby emit light. With this two-layer electroluminescent device, the color of emitted light can be changed by choosing the type of the electroluminescent material. For example, a low molecular compound of an aluminum quinolinol complex ($Alq_3$) is used as the electroluminescent material. Green electroluminescence is obtained by the use of the aluminum quinolinol complex as the electroluminescent material.

However, this two-layer electroluminescent device has a drawback in that the above low molecular electroluminescent material forming the electroluminescent layer is gradually crystallized to cause detachment at the interface of the electroluminescent layer and the electrode with the result that the electroluminescence performance is deteriorated. Further, there is a case that the two-layer electroluminescent device generates heat with the emission of light to markedly increase the temperature of the device, so that the device is deteriorated.

It has been proposed to form the above electron injecting/transporting layer, electroluminescent layer or hole injecting/transporting layer out of a thin film of a polymer to thereby avoid the degradation and crystallization of the layer. For example, in Japanese Patent Laid-Open Publication No. 2096/1992, a process for producing a polymeric thin-film electroluminescent device is described in which a polymeric thin film comprising a low molecular electroluminescent material or a low molecular material capable of hole injection and electron transport is formed by a wet process, such as spin coating or immersion coating.

However, tens of Volts are required to be applied to the thus obtained device for providing effective electroluminescent brightness. This gives an electroluminescent brightness of up to 200 cd/$m^2$.

In the formation of the above polymeric thin film comprising an low molecular electroluminescent material or a low molecular material capable of hole injection and electron transport on an electrode by spin coating, there is a drawback such that pin holes are likely to occur in the formed polymeric thin film, which cause the device to break during the drive thereof.

Further, the formation of the polymeric thin film according to the wet process has a drawback in that impurities are likely to mingle into the device, thereby becoming the cause of the deterioration of the device.

The polymeric thin-film electroluminescent device comprising the polymeric thin film formed according to the above wet process is unfavorably likely to have lowered efficiency in electron and hole injection or likely to be broken, although advantageously the low molecular material contained in the polymeric thin film is less likely to crystallize. Further, when the electroluminescent device is produced by forming an organic layer (upper layer) on an organic layer (sublayer) according to the wet process, there is difficulty in selecting a solvent which does not dissolve or leach the organic sublayer in the preparation of a coating fluid for forming the upper organic layer.

In the formation of an organic layer (upper layer) on an organic layer (sublayer) according to the wet process, the materials usable for forming the sublayer and the upper layer and the solvents for dissolving the materials are limited. Consequently, there is a problem that the types of the polymeric materials capable of forming the organic layer of the polymeric thin-film electroluminescent device and the low molecular materials which can be contained in the polymeric materials are extremely limited.

Thus, the present applicant proposed, prior to the filing of the present application, a method of forming an electroluminescent layer and/or a charge injecting/transporting layer of an organic electroluminescent device according to the vapor deposition polymerization (Japanese Patent Application 5(1993)-103038).

In this method, for example, an acid chloride represented by the following general formula:

(XII)

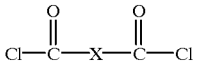

wherein X represents a divalent organic group, and a dicarbohydrazide represented by the following general formula:

(XIII)

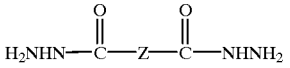

wherein Z represents a divalent organic group, are subjected to a vapor deposition polymerization, thereby forming an electroluminescent layer and/or a charge injecting/transporting layer composed of a thin film of polyoxadiazoles each having a repeating unit represented by the following general formula:

(XI)

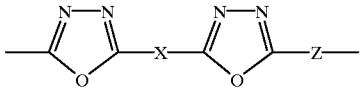

wherein X and Z are as defined above.

Although an organic electroluminescent device having an organic electroluminescent layer and/or an organic charge transporting layer having fair durability and heat resistance are obtained by the above method, further improvements are desired in such properties.

Moreover, in the above method, an acid (HCl) is generated in the course of the formation of the electroluminescent layer and/or charge injecting/transporting layer, so that its adverse effects on the electrodes and the device are feared. Therefore, a process for producing an organic electroluminescent device is desired in which an electroluminescent layer and/or a charge injecting/transporting layer can be formed without producing by-products of acids during the reaction.

OBJECT OF THE INVENTION

An object of the first invention is to provide an organic electroluminescent device having an organic electroluminescent layer and/or an organic charge injecting/transporting layer which is excellent in durability and heat resistance and a process for producing the same.

An object of the second invention is to provide a process for producing an organic electroluminescent device in which an electroluminescent layer and/or a charge injecting/transporting layer can be formed according to the vapor deposition polymerization process without producing by-products of acids.

SUMMARY OF THE INVENTION

The organic thin-film electroluminescent device of the first invention comprises electrodes, at least one of the electrodes being transparent, and, interposed therebetween, an electroluminescent layer and/or a charge injecting/transporting layer formed out of a thin film of network polymers (polymers having network structure) obtained by the vapor deposition polymerization process.

It is preferred that the above thin film be one composed of polymers each having oxadiazole units (hereinafter referred to as "thin film of polyoxadiazoles").

A process of the first invention for producing an organic electroluminescent device (element) comprises:

providing monomer A selected from a bifunctional monomer represented by the following formula (I) and monomer B selected from a polyfunctional monomer represented by the following formula (II) or a mixture of this polyfunctional monomer and a bifunctional monomer represented by the following formula (III):

(I)

$$R^1\text{—}(a)_2$$

(II)

$$R^2\text{—}(b)_m$$

-continued (III)

$$R^3\text{—}(c)_2$$

wherein:

m is an integer of 3 or greater, each of $R^1$ and $R^3$ may be the same or different from each other and independently represents a divalent organic group, $R^2$ represents an m-valent organic group (provided that m is an integer of 3 or greater), a represents a group selected from a carboxylic acid halide group, a carbohydrazide group and a silylated carbohydrazide group represented by the following formula:

(IV)

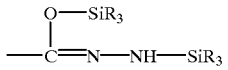

wherein R represents an alkyl or aryl group having not more than 6 carbon atoms, provided that, when a is a carboxylic acid halide group, each of b and c is a carbohydrazide group or a silylated carbohydrazide group represented by the above formula (IV) and that, when a is a carbohydrazide group or a silylated carbohydrazide group represented by the above formula (IV), b and c are respective carboxylic acid halide;

evaporating the monomers A and B from respective separate vapor sources in vacuum so that a thin film of polyoxadiazole precursors is formed between electrodes, at least one of which is transparent; and heating the thin film at 100 to 400° C. in vacuum or an inert gas, thereby converting the polyoxadiazole precursors to polyoxadiazoles so that an electroluminescent layer and/or a charge injecting/transporting layer is formed out of the thin film of the polyoxadiazoles.

A process of the second invention for producing an organic electroluminescent device comprises:

subjecting a carboxylic acid derivative represented by the following formula:

(VIII)

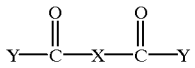

wherein X represents a divalent organic group and Y represents a halogen atom; and a silylated dicarbohydrazide represented by the formula:

(IX)

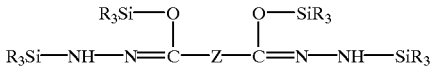

wherein Z represents a divalent organic group and R represents an alkyl or aryl group having not more than 6 carbon atoms, to a vapor deposition polymerization on a surface to be vapor deposited, thereby forming a thin film of polymers each having a repeating unit represented by the formula:

(X)

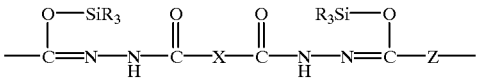

wherein X, Z and R are as defined above; and heating the thin film at 100 to 400° C. in vacuum or an inert gas, thereby forming an electroluminescent layer and/or a charge injecting/transporting layer composed of (comprising) a thin film of polyoxadiazoles each having a repeating unit represented by the formula:

(XI)

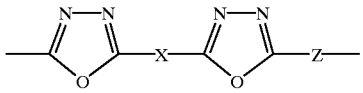

wherein X and Z are as defined above.

DETAILED DESCRIPTION OF THE INVENTION

The organic electroluminescent device of the present invention and the process of the present invention for producing the same will be described in detail below with reference to the drawings.

Organic Electroluminescent Device

FIGS. 1 to 4 illustrate the first to fourth embodiments of organic electroluminescent devices of the first invention, respectively.

Figure 1:
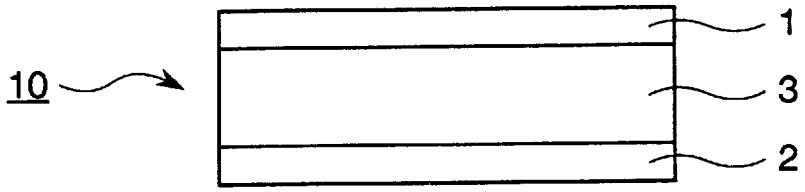
FIG. 1 is a sectional view schematically illustrating the structure of a first embodiment of organic thin-film electroluminescent device of the first invention.

The first embodiment of organic electroluminescent device 10 of the first invention as illustrated in FIG. 1 has a laminate structure composed of a negative electrode 1/an electroluminescent layer 3/a positive electrode 2.

Figure 2:
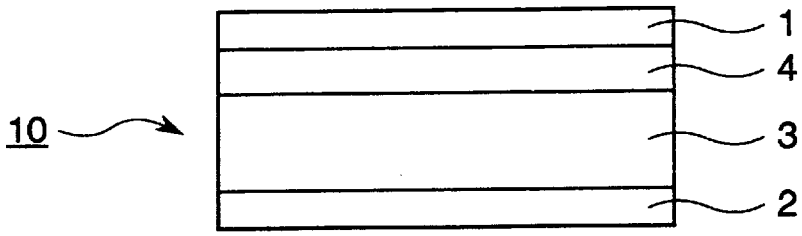
FIG. 2 is a sectional view schematically illustrating the structure of a second embodiment of organic thin-film electroluminescent device of the first invention.

The second embodiment of organic electroluminescent device 10 of the first invention as illustrated in FIG. 2 has a laminate structure composed of a negative electrode 1/an electron injecting/transporting layer 4/an electroluminescent layer 3/a positive electrode 2.

Figure 3:
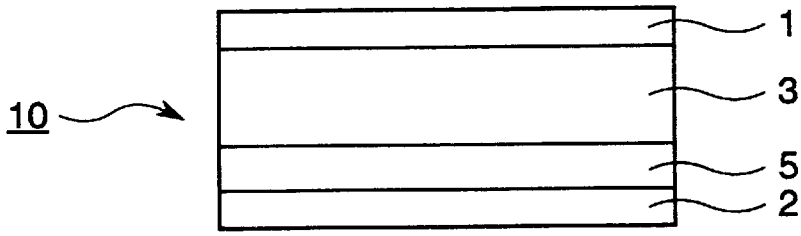
FIG. 3 is a sectional view schematically illustrating the structure of a third embodiment of organic thin-film electroluminescent device of the first invention.

The third embodiment of organic electroluminescent device 10 of the first invention as illustrated in FIG. 3 has a laminate structure composed of a negative electrode 1/an electroluminescent layer 3/a hole injecting/transporting layer 5/a positive electrode 2.

Figure 4:
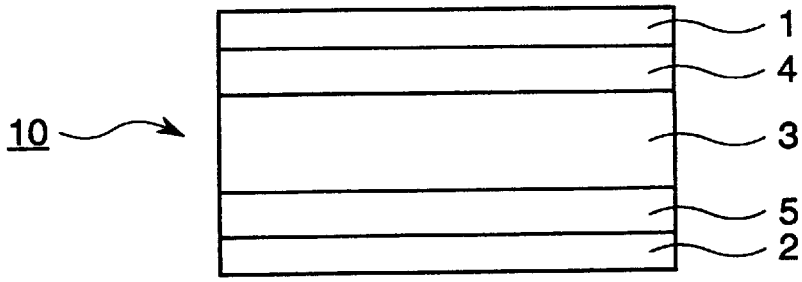
FIG. 4 is a sectional view schematically illustrating the structure of a fourth embodiment of organic thin-film electroluminescent device of the first invention.

The fourth embodiment of organic electroluminescent device 10 of the first invention as illustrated in FIG. 4 has a laminate structure composed of a negative electrode 1/an electron injecting/transporting layer 4/an electroluminescent layer 3/a hole injecting/transporting layer 5/a positive electrode 2.

In the first to fourth forms of organic electroluminescent devices of the first invention as illustrated in FIGS. 1 to 4, without exception, an electrode formed out of Mg, Ag, In, Ca, Al or the like is used as the negative electrode 1 (electron injecting electrode) and an electrode formed out of ITO (Indium Tin Oxide), Au or the like as the positive electrode 2 (hole injecting electrode).

At least one of the negative electrode 1 and the positive electrode 2 is transparent, through which irradiation of light can be emitted to the electroluminescent layer 3.

Generally, either the negative electrode 1 or the positive electrode 2 is formed on a transparent plate of glass, a polymer film or the like. For example, when the positive electrode 2 is composed of ITO, the ITO electrode is formed in the form of a thin film on a transparent plate of glass, a polymer film or the like.

In the first embodiment of organic electroluminescent device 10 of the first invention, the electroluminescent layer 3 illustrated in FIG. 1 is composed of a thin film of network polymers.

In the second embodiment of organic electroluminescent device 10 of the first invention, at least one or preferably both of the electron injecting/transporting layer 4 and the electroluminescent layer 3 illustrated in FIG. 2 are composed of a thin film of network polymers.

In the third embodiment of organic electroluminescent device 10 of the first invention, at least one or preferably both of the electroluminescent layer 3 and the hole injecting/transporting layer 5 illustrated in FIG. 3 are composed of a thin film of network polymers.

In the fourth embodiment of organic electroluminescent device 10 of the first invention, at least one or preferably all of the electron injecting/transporting layer 4, the electroluminescent layer 3 and the hole injecting/transporting layer 5 illustrated in FIG. 4 are composed of a thin film of network polymers.

In the formation of the electroluminescent layer 3 out of a thin film of network polymers of the first invention, it is preferred that the thin film is that obtained by the vapor deposition polymerization process and that its thickness range is from 100 to 2000 Å, especially from 300 to 1000 Å.

In the formation of the electron injecting/transporting layer 4 or the hole injecting/transporting layer 5 out of a thin film of network polymers of the first invention, it is preferred that the thin film is that obtained by the vapor deposition polymerization process and that its thickness range is from 100 to 5000 Å, especially from 300 to 1000 Å.

The above thin film of network polymers is obtained by the polycondensation or polyaddition of a polyfunctional monomer including an m-functional monomer (m is an integer of at least 3) according to the vapor deposition polymerization process. In particular, it is formed by the mutual bonding of at least one polymer unit selected from among oxadiazole unit, imide bond, amide bond, amide-imide bond, urea bond and azomethine bond.

Among the polymer units, the oxadiazole unit has self-electroluminescent properties, so that it is preferred that the thin film of network polymers comprise oxadiazole units. That is, when the thin film of network polymers is formed out of polymers having oxadiazole units, it exhibits excellent electroluminescence.

Especially, detailed description will be made below with respect to the polyoxadiazole having network structure.

In the above polyoxadiazole of network structure, the divalent organic group $R^1$ and the m-valent organic group $R^2$ (m is an integer of 3 or greater) are bonded together via the divalent oxadiazole represented by the following formula:

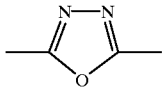

to thereby form a network. It is not necessary for all the $R^1$ groups to be individually bonded with the $R^2$ group via the above divalent oxadiazole. Part of the $R^1$ groups may be individually bonded with the $R^3$ group via the above divalent oxadiazole.

It is preferred that the value of $[R^3/(R^2+R^3)]\times100$ range from 0 to 90 mol %.

With respect to the above polyoxadiazole of network structure, the oxadiazole ring has self-electroluminescent properties, so that there is no limitation except that $R^1$ and $R^3$ are divalent organic groups and $R^2$ is an m-valent organic group (m is an integer of 3 or greater). However, when the electron injecting/transporting layer 4 or the hole injecting/transporting layer 5 is formed out of the polyoxadiazole of network structure, it is preferred that the polyoxadiazole be produced from the starting materials described later.

It is preferred that $R^1$ and $R^2$ be organic groups having respective aromatic rings. When at least one of $R^1$ and $R^2$ is an organic group having an aromatic ring, i.e., a divalent organic group composed mainly of a unit capable of π-electron conjugation so as to enable electron delocalization such as a phenylene group, a biphenylene group or a divalent organic group derived from a triphenylamine, the electron injecting/transporting layer 4 can possess improved ability of electron transporting and the hole injecting/transporting layer 5 improved ability of hole transporting.

When it is desired to enhance the ability of electron transporting in the electron injecting/transporting layer 4, an additive for promoting electron injection and transport, such as diphenoquinone and fluorenone derivatives disclosed in Chem. Mater., Vol. 3 (1991) pp. 709–714 and J. Imag. Sci., Vol. 29, No. 2 (1985) pp. 69–72, may be added in an amount of generally from 0.01 to 80 mol %, preferably from 1 to 60 mol % per oxadiazole unit of the above polyoxadiazole. Also, when it is desired to enhance the ability of hole transport in the hole injecting/transporting layer 5, an additive for promoting hole injection and transport, such as 4,4',4"-tris(N,N-diphenylamino)triphenylamine, 4,4',4"-tris[N-(3-methylphenyl)-N-phenylamino)triphenylamine and other triphenylamine derivatives disclosed in Chem. Lett., 1989, p.1145, may be added in an amount of generally from 0.01 to 80 mol %, preferably from 1 to 50 mol % per oxadiazole unit of the above polyoxadiazole. As apparent from the above, the organic electroluminescent device of the first invention can be modified in various ways as long as such modification falls within the scope of the claims.

In each of the above organic electroluminescent devices 10 illustrated in FIGS. 1 to 4, a protective film, such as an antioxidant film, may be provided so as to cover the surface of the portion thereof where a negative electrode 1 or a positive electrode 2 is formed. Alternatively, the whole of the organic electroluminescent device 10 may be sealed with the above protective film. The formation of the protective film on the negative electrode 1 or positive electrode 2 increases the stability of the negative electrode 1 or the positive electrode 2, thereby improving the practicability and durability of the organic electroluminescent device 10. This protective film may be composed of a metal exhibiting a high work function, an epoxy resin, a silicone resin or a fluorinated resin.

Process for Producing Organic Electroluminescent Device

The above thin-film electroluminescent device having an electroluminescent layer and/or a charge injecting/transporting layer formed out of a polymeric thin film obtained by polycondensation or polyaddition of a polyfunctional monomer can be produced through the steps of:

(1) forming an electrode 1 or 2 on a plate;

(2) optionally forming a first charge injecting/transporting layer 4 or 5 on the electrode 1 or 2 according to the vapor deposition polymerization process;

(3) forming an electroluminescent layer 3 on either the electrode 1 or 2 or the first charge injecting/transporting layer 4 or 5 according to the vapor deposition polymerization process;

(4) optionally forming a second charge injecting/transporting layer 4 or 5 capable of transporting charges opposite to those transported by the first charge injecting/transporting layer 4 or 5 (for example, the second charge transporting layer is a hole transporting layer 5 when the first charge transporting layer is an electron transporting layer 4) on the electroluminescent layer 3 according to the vapor deposition polymerization process;

(5) forming a counter electrode 1 or 2 [when the electrode formed (for example, in step 1) is a negative electrode 1, the counter electrode is a positive electrode 2] on either the electroluminescent layer 3 or the second charge transporting layer 4 or 5; and (6) optionally forming a sealing layer for electroluminescent element on the counter electrode.

In particular, the electroluminescent layer or charge injecting/transporting layer composed of a thin film of polyoxadiazoles can be formed by the process comprising:

providing monomer A consisting of a bifunctional monomer represented by the following formula (I) and monomer B consisting of a polyfunctional monomer represented by the following formula (II) and/or a bifunctional monomer represented by the following formula (III):

$$R^1\text{—}(a)_2 \quad \text{(I)}$$

$$R^2\text{—}(b)_m \quad \text{(II)}$$

$$R^3\text{—}(c)_2 \quad \text{(III)}$$

evaporating the monomers A and B from respective separate vapor sources in vacuum so that a thin film of polyoxadiazole precursors is formed between electrodes, at least one of which is transparent; and heating the thin film at 100 to 400° C., preferably 100 to 350° C. and still preferably 200 to 300° C. in vacuum or an inert gas for preferably 10 to 240 min, still preferably 60 to 120 min, thereby converting the polyoxadiazole precursors to polyoxadiazoles.

In the above formulae (I) to (III), m is an integer of 3 or greater, each of $R^1$ and $R^3$ independently represents a divalent organic group, $R^2$ represents an m-valent organic group (provided that m is an integer of 3 or greater), a represents a group selected from a carboxylic acid halide group, a carbohydrazide group and a silylated carbohydrazide group represented by the following formula:

(IV)

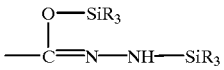

wherein R represents an alkyl or aryl group having not more than 6 carbon atoms, provided that, when a is a carboxylic acid halide group, each of b and c is a carbohydrazide group or a silylated carbohydrazide group represented by the above formula (IV) and that, when a is a carbohydrazide group or a silylated carbohydrazide group represented by the above formula (IV), b and c are respective carboxylic acid halide.

In either case, b and c may be identical with or different from each other.

In the first process of the first invention for producing an organic electroluminescent device, a polyfunctional monomer represented by the above formula (II) or a mixture of this polyfunctional monomer and a bifunctional monomer represented by the above formula (III) is used as monomer B to thereby form an electroluminescent layer and/or a charge injecting/transporting layer out of a thin film of polyoxadiazoles of network structure having excellent heat resistance and durability.

Examples of the above bifunctional monomers represented by the above formula (I), polyfunctional monomers represented by the above formula (II) and bifunctional monomers represented by the above formula (III) include monomers represented by the following formulae (V), (VI) and (VII), respectively.

(V)

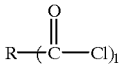

(VI)

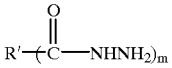

(VII)

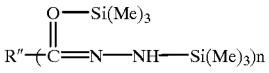

In the above formulae, R, R' and R" represent ι-valent, m-valent and n-valent organic groups, respectively.

When 1=2, m and/or n is an integer of 3 or greater. When 1 is an integer of 3 or greater, m or n is 2.

When 1 is 2 while m is an integer of 3 or greater, or when 1 is an integer of 3 or greater while m is 2, an electroluminescent layer and/or a charge injecting/transporting layer is formed out of a thin film of polyoxadiazoles of network structure through the step of reacting the monomer represented by the above formula (V) with the monomer represented by the above formula (VI).

Likewise, when 1 is 2 while n is an integer of 3 or greater, or when 1 is an integer of 3 or greater while n is 2, an electroluminescent layer and/or a charge injecting/transporting layer is formed out of a thin film of polyoxadiazoles of network structure through the step of reacting the monomer represented by the above formula (V) with the monomer represented by the above formula (VII).

In the production of an organic electroluminescent device having the electroluminescent layer and/or a charge injecting/transporting layer formed out of a thin film of polyoxadiazoles of network structure in the above manner, the molar ratio of the monomer represented by the above formula (V) to the monomer represented by the above formula (VI) ((V):(VII) and the molar ratio of the monomer represented by the above formula (V) to the monomer represented by the above formula (VII) ((V):(VII)) during the polymerization are preferred to be regulated to m:1 and n:1, respectively, for attaining stoichiometric reaction between the monomers.

In the above manner, an organic electroluminescent device having an electroluminescent layer and/or a charge injecting/transporting layer formed out of a thin film of polyoxadiazoles of network structure is produced through the step of reacting a bifunctional monomer (e.g., monomer represented by the above formula (V) when 1=2) with a polyfunctional monomer of 3 or higher in functionality (e.g., monomer represented by the above formula (VI) when m is an integer of 3 or greater). The above polyfunctional monomer includes a mixture of this polyfunctional monomer and a bifunctional monomer, in which the content of the bifunctional monomer preferably ranges from 0 to 90 mol %.

In the formation of a charge injecting/transporting layer of an organic electroluminescent device out of a thin film of polyoxadiazoles, it is preferred that at least one member of the compounds represented by the above formula (I) to (III) be selected from the following compound group (A) and compounds obtained by combining them by means of a bonding group.

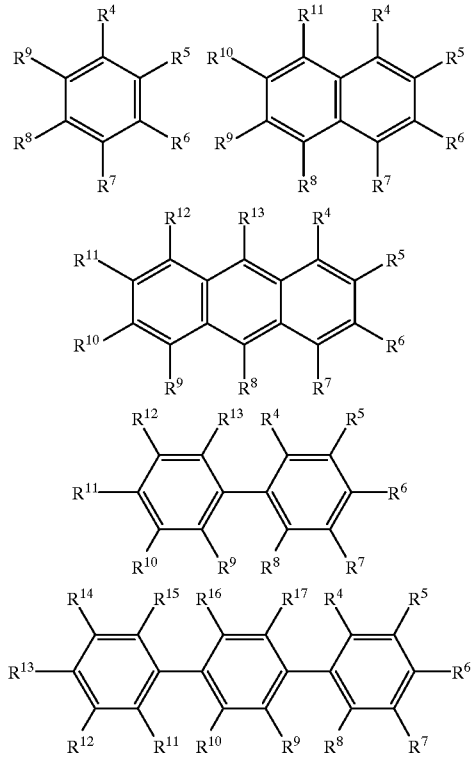

-continued

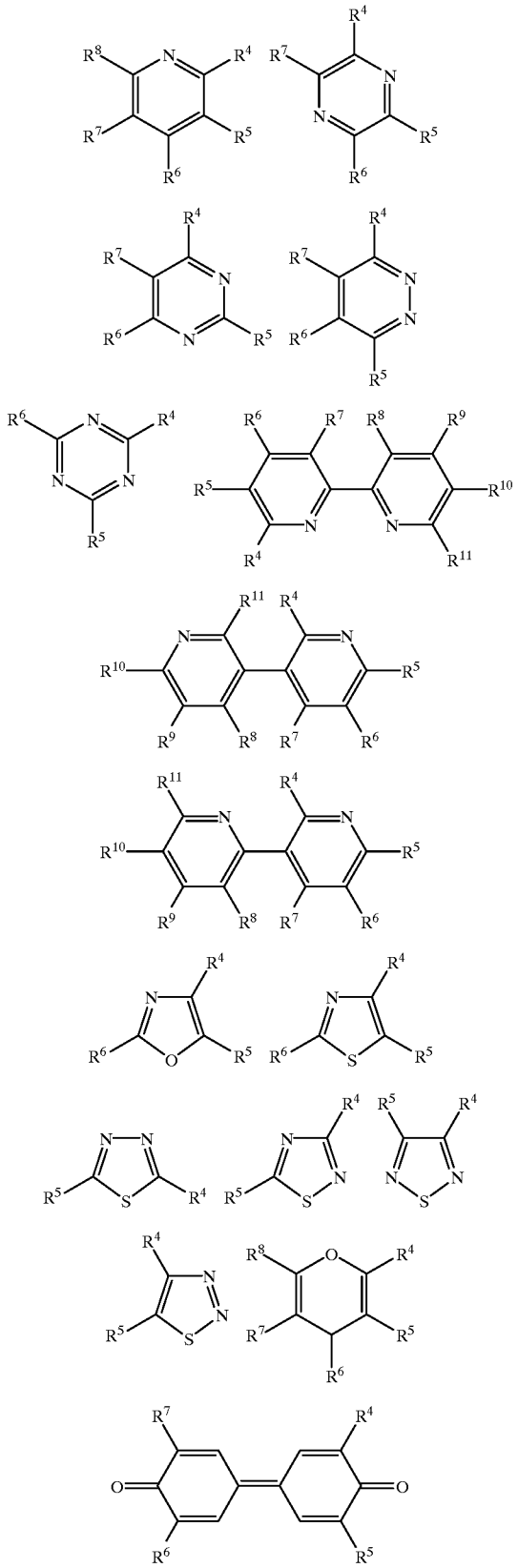

-continued

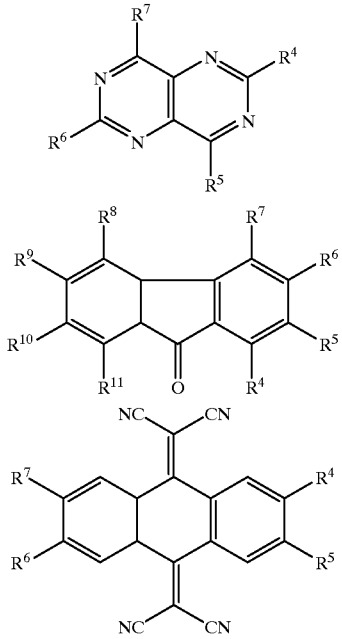

When a compound selected from the above exemplary compound group (A) is employed as the compound represented by the above formula (I) or (III), two of the $R^4$ to $R^{17}$ substituents of the compounds in the above exemplary compound group (A) are each independently reactive substituent selected from carboxylic acid halide groups such as carboxylic acid chloride groups, carbohydrazide groups and the silylated carbohydrazide groups represented by the above formula (IV). When an m-valent compound selected from the above exemplary compound group is employed as the compound represented by the above formula (II), the m substituents of the $R^4$ to $R^{17}$ substituents of the compounds in the above exemplary compound group (A) are each independently reactive substituent selected from carboxylic acid halide groups, carbohydrazide groups and the silylated carbohydrazide groups represented by the above formula (IV).

Each of the other substituents of the compounds in the above exemplary compound group (A) is independently a group selected from the group consisting of a hydrogen atom, a halogen atom, a cyano group, a nitro group, an alkyl group, an aralkyl group and an alkyloxy group.

When the compounds represented by the above formulae (I) to (III) are those obtained by bonding compounds in the above exemplary compound group (A) by means of a bonding group, at least one member of the above other substituents is a direct bond or a bonding group such as —$CH_2$—, —$SiH_2$—, —O—, —S—, —$C(CH_3)_2$—, —CH($CH_3$)—, —CH(Ph)— or —$Si(CH_3)_2$—. Via this direct bond or bonding group, a plurality of compounds are bonded together. The plurality of compounds may be identical with or different from each other and are selected from the above exemplary compound group (A).

In the formation of a hole injecting/transporting layer of an organic electroluminescent device out of a thin film of polyoxadiazoles, it is preferred that at least one member of the compounds represented by the above formula (I) to (III) be selected from the following compound group (B) and compounds obtained by combining them by means of a bonding group.
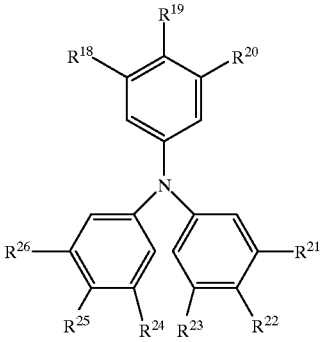
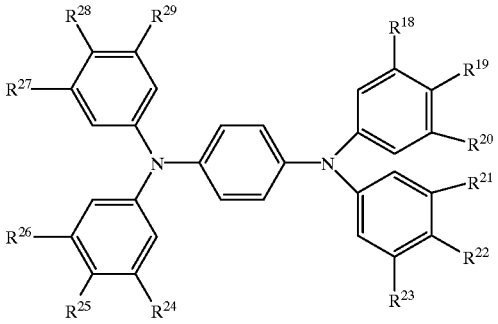
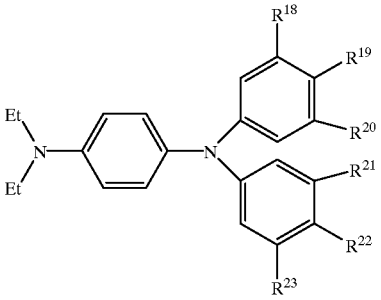
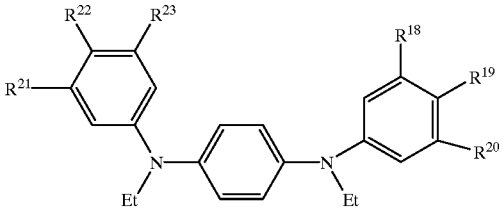
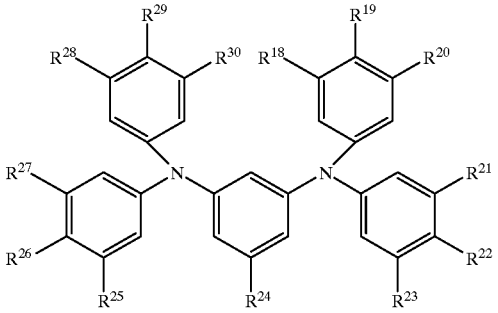
-continued
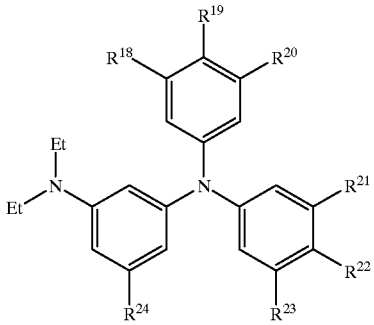
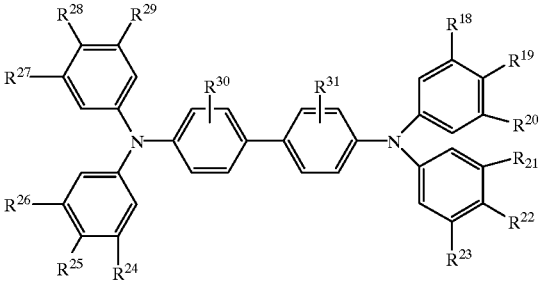
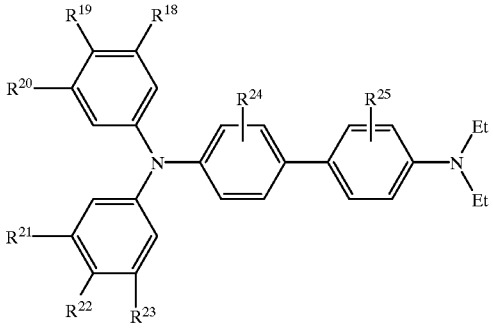
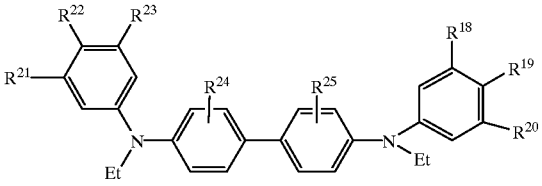
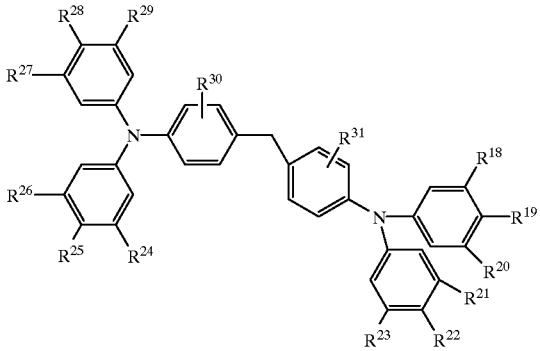

-continued

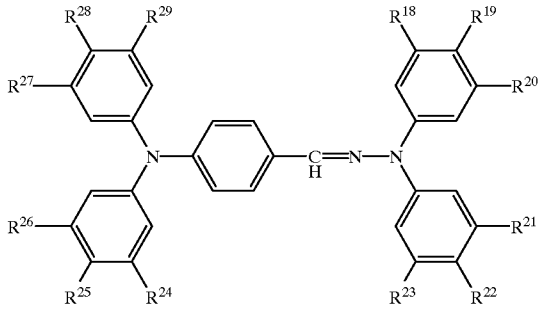

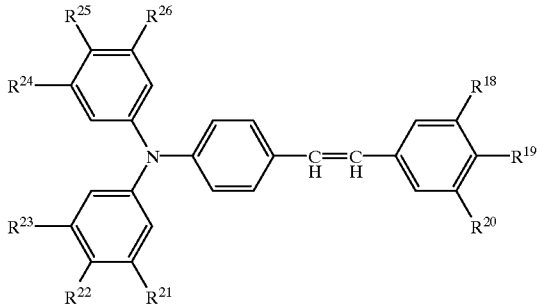

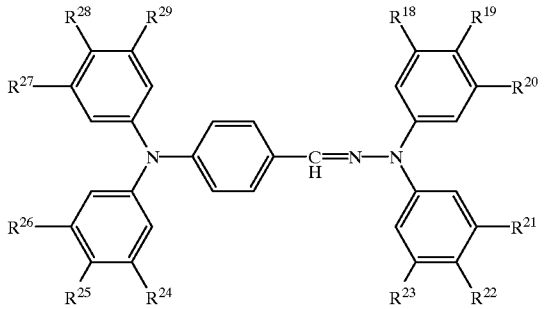

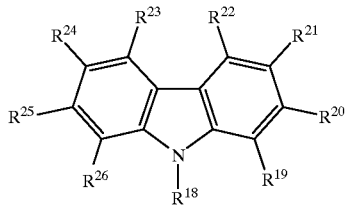

When a compound selected from the above exemplary compound group (B) is employed as the compound represented by the above formula (I) or (III), two of the $R^{18}$ to $R^{31}$ substituents of the compounds in the above exemplary compound group (B) are each independently reactive substituent selected from carboxylic acid halide groups, carbohydrazide groups and the silylated carbohydrazide groups represented by the above formula (IV). When an m-valent compound selected from the above exemplary compound group (B) is employed as the compound represented by the above formula (II), the m substituents of the $R^{18}$ to $R^{31}$ substituents of the compounds of the above exemplary compound group (B) are each independently reactive substituent selected from carboxylic acid halide groups, carbohydrazide groups and the silylated carbohydrazide groups represented by the above formula (IV).

Each of the other substituents of the compounds of the above exemplary compound group (B) is independently a group selected from the group consisting of a hydrogen atom, a halogen atom, a cyano group, a nitro group, an alkyl group, an aralkyl group and an alkyloxy group.

When the compounds represented by the above formulae (I) to (III) are those obtained by bonding compounds of the above exemplary compound group (B) by means of a bonding group, at least one member of the above other substituents is a direct bond or a bonding group such as —$CH_2$—, —$SiH_2$—, —O—, —S—, —$C(CH_3)_2$—, —CH($CH_3$)—, —CH(Ph)— or —$Si(CH_3)_2$—. Via this direct bond or bonding group, a plurality of compounds are bonded together.

The plurality of compounds may be identical with or different from each other. In the formation of an electroluminescent layer of an organic electroluminescent device out of a thin film of polyoxadiazoles, there is no particular limitation except that $R^1$ of the above formula (I) and $R^2$ of the above formula (II) are respective divalent organic groups and that $R^3$ of the above formula (III) is a divalent organic group, because the polyoxadiazoles themselves have fluorescence self-emitting capability. However, when compounds of the above exemplary compound group (B) or those obtained by bonding them are used as the compounds represented by the above formulae (I) to (III), advantageously not only electroluminescent capability but also capability of charge injection and transportation are imparted to the thin film of polyoxadiazoles as the electroluminescent layer.

Further enhanced electroluminescent intensity can be realized by the use of residues derived from dyes for laser selected from the following compound group (C) as the above $R^1$ and $R^3$.

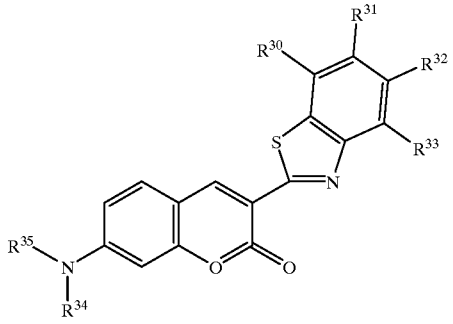

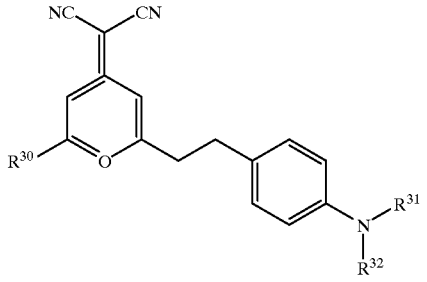

-continued

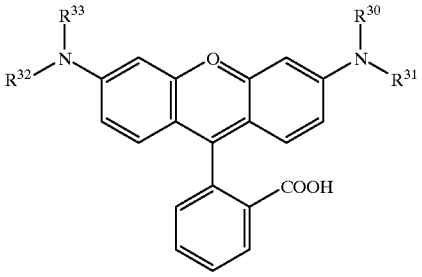

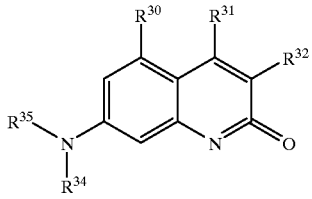

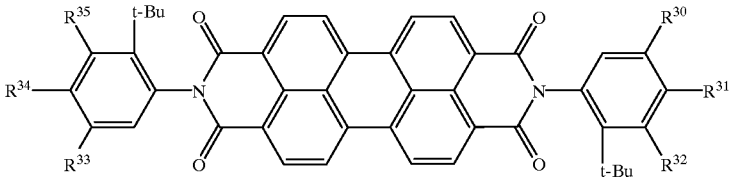

When a compound selected from the above exemplary compound group (C) is employed as the compound represented by the above formula (I) or (III), two of the $R^{30}$ to $R^{35}$ substituents of the compounds in the above exemplary compound group (C) are each independently reactive substitudent selected from carboxylic acid halide groups, carbohydrazide groups and the silylated carbohydrazide groups represented by the above formula (IV). When an m-valent compound selected from the above exemplary compound group (C) is employed as the compound represented by the above formula (II), the m substituents of the $R^{30}$ to $R^{35}$ substituents of the compounds of the above exemplary compound group (C) are each independently reactive substituent selected from carboxylic acid halide groups, carbohydrazide groups and the silylated carbohydrazide groups represented by the above formula (IV).

Each of the other substituents of the compounds of the above exemplary compound group is independently a group selected from the group consisting of a hydrogen atom, a halogen atom, a cyano group, a nitro group, an alkyl group, an aralkyl group and an alkyloxy group.

An electroluminescent layer formed out of a thin film of polymers each having any of the above bonding units derived from fluorescent dyes or pigments and the xadiazole unit emits fluorescence characteristic of the relevant fluorescent dye or pigment at the time of electroluminescence. For example, an electroluminescent device having an electroluminescent layer formed out of a thin film of polymers each having any of the above bonding units derived from fluorescent dyes or pigments, such as coumarin 343, aluminum quinolinol complex, NK 757 and DCM, and the oxadiazole unit emits bluish-green, green, yellow or red light depending on the type of relevant fluorescent dye or pigment.

Now, the process of the second invention for producing an organic electroluminescent device will be described in greater detail.

The process of the second invention for producing an organic electroluminescent device comprises:

subjecting a carboxylic acid derivative represented by the following formula:

(VIII)

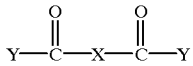

wherein X represents a divalent organic group and Y represents a halogen atom; and a silylated dicarbohydrazide represented by the formula:

(IX)

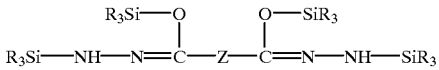

wherein Z represents a divalent organic group and R represents an alkyl or aryl group having not more than 6 carbon atoms, to a vapor deposition polymerization on a surface to be vapor deposited, thereby forming a thin film of polymers each having a repeating unit represented by the formula:

(X)

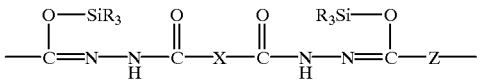

wherein X, Z and R are as defined above; and heating the thin film at 100 to 400° C., preferably 100 to 350° C., in vacuum or an inert gas, thereby forming an electroluminescent layer and/or a charge injecting/transporting layer composed of a thin film of polyoxadiazoles each having a repeating unit represented by the formula:

(XI)

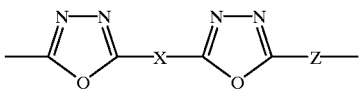

wherein X and Z are as defined above.

The above process of the second invention for producing an organic electroluminescent device is substantially similar to the above process of the first invention for producing an organic electroluminescent device, except that the carboxylic acid derivative represented by the above formula (VIII) is employed as monomer A (or monomer B) and the silylated dicarbohydrazide represented by the above formula (IX) as monomer B (or monomer A). Further, the carboxylic acid derivative represented by the above formula (VIII) corresponds to the compound represented by the above formula (I) which was employed in the process of the first invention for producing an organic electroluminescent device, and the silylated dicarbohydrazide represented by the above formula (IX) is regarded to be included in the compound represented by the above formula (I).

The vapor deposition polymerization on a surface of the carboxylic acid derivative represented by the above formula (VIII) and the silylated dicarbohydrazide represented by the above formula (IX) forms a thin film of polymers each having a repeating unit represented by the following general formula:

(X)

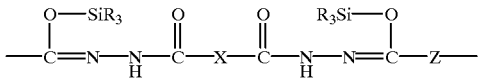

wherein X, Z and R are as defined above.

In this vapor deposition polymerization, it is important to accurately control the rate of evaporation of each of the above two types of monomers so as to effect stoichiometric control of the amount of each monomer evaporated.

However, when a monomer is present which evaporates at room temperature prior to reaching a predetermined degree of vacuum, it is difficult to accurately control the rate of evaporation of the monomer. Therefore, it is preferred that the monomer for use in the vapor deposition polymerization be selected from among the compounds which scarcely evaporate at room temperature or below before reaching a predetermined degree of vacuum.

In the second invention, the above two types of monomers are generally evaporated at a rate of at least 10— 10 mol/cm$^2$sec under a pressure of $10^{-2}$ to $10^{-4}$ Pa, preferably $10^{-3}$ to $10^{-4}$ Pa and polymerized on a surface to be vapor deposited.

Therefore, it is desired that the above two types of monomers can be individually evaporated at a rate of at least $10^{-10}$ to $10^{-5}$ mol/cm$^2$sec at 40 to 400° C., preferably 70 to 300° C. and still preferably 100 to 250° C. under a pressure within the above range.

From the above viewpoint, it is preferred that the silylated dicarbohydrazide represented by the above formula (IX) have as its R a group selected from the group consisting of methyl, ethyl, n-propyl, isopropyl, n-butyl, isobutyl, sec-butyl, pentyl and phenyl groups.

For example, when Y of the above formula (VIII) represents a chlorine atom and R of the above formula (IX) represents a methyl group, the carboxylic acid derivative represented by the above formula (VIII) reacts during the vapor deposition polymerization with the terminal of trimethylsilylated dicarbohydrazide represented by the above formula (IX), —$Si(CH_3)_3$, to thereby form chlorotrimethylsilane of the formula $ClSi(CH_3)_3$ by by-product. It is less probable for this by-product to corrode the electrode of the organic electroluminescent device or the body of the vapor deposition apparatus as different from the above inorganic acid.

In the second invention, the thin film of polymers each having the repeating unit represented by the above formula (X) is then heated at 100 to 400° C. in vacuum or an inert gas stream, thereby forming an electroluminescent layer and/or a charge injecting/transporting layer composed of a thin film of polyoxadiazoles each having a repeating unit represented by the formula:

(XI)

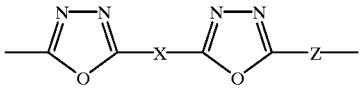

wherein each of X and Z independently represents a divalent organic group.

It is preferred that the thickness of each of the thus formed layers range from 200 to 2000 Å from the viewpoint that an organic electroluminescent device which is excellent in electroluminescent efficiency, heat resistance and durability can be obtained.

The polyoxadiazole of the thin film represented by the above formula (XI) comprises oxadiazole rings as polymer units, and the oxadiazole rings per se have electroluminescent properties. However, if X and/or Z of the above formula (XI) has electroluminescent and charge injecting/transporting properties, the electroluminescent efficiency of the organic electroluminescent device can be further improved. From this viewpoint, it is preferred that the above X and/or Z be a group having electroluminescent and/or charge injecting/transporting properties.

With respect to the above organic groups X and Z, the organic group X is a group derived from the carboxylic acid derivative represented by the above formula (VIII) and the organic group Z a group derived from the dicarbohydrazide represented by the above formula (IX). That is, all the organic groups X of the above formulae (VIII), (X) and (XI) are identical groups and all the organic groups Z of the above formulae (IX), (X) and (XI) are identical groups.

The above organic groups X and Z may be identical with or different from each other. For producing an organic electroluminescent device having high electroluminescent efficiency, it is preferred that each thereof represent a divalent organic group composed mainly of a unit capable of conjugating with n electrons so as to be capable of delocalizing charges, especially a vinylene group, a phenylene group, a biphenylene group or a divalent group derived from triphenylamine. When each of the above organic groups X and Z is selected from among a vinylene group, a phenylene group, a biphenylene group and a divalent group derived from triphenylamine, these may be substituted with a group selected from the group consisting of alkyl, allyl, aryl and aralkyl groups.

In the production of an organic electroluminescent device having a charge injecting/transporting layer formed out of a thin film of polyoxadiazoles with high capability of electron charge and transport in conformity with the process of the second invention for producing an organic electroluminescent device, it is preferred that the organic groups X and Z be respective groups selected from among the following substituent group (1) or groups obtained by combining them. These groups can be formed from the compounds of the above compound group (A).

(1)
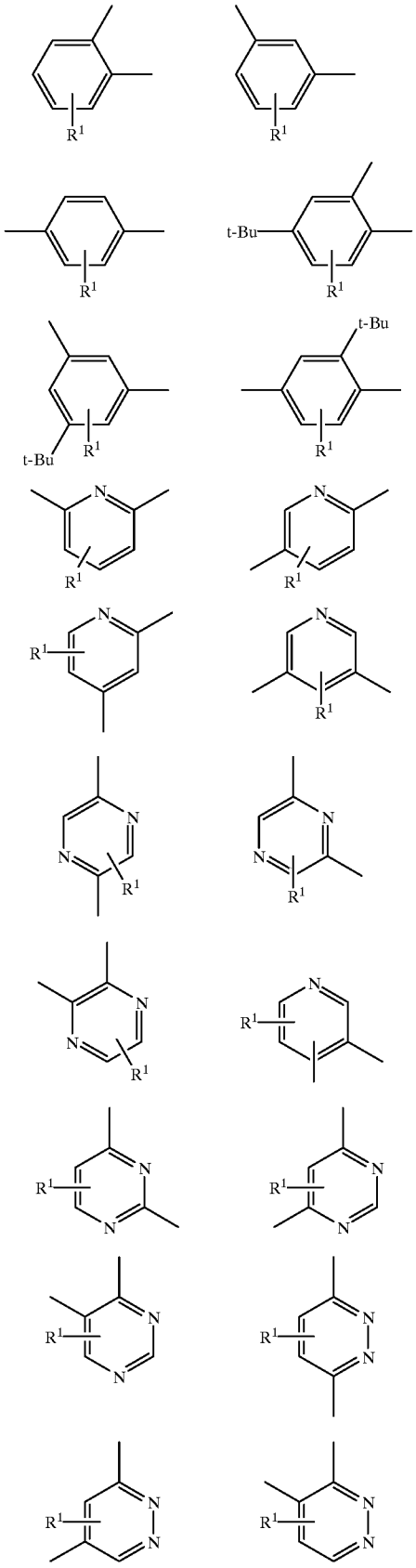
-continued
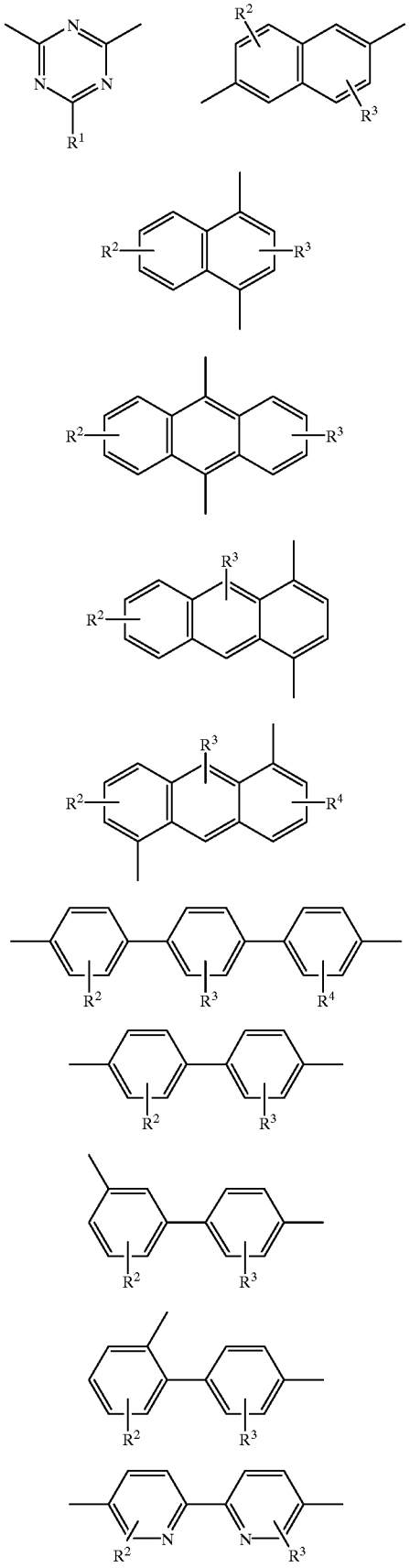

-continued
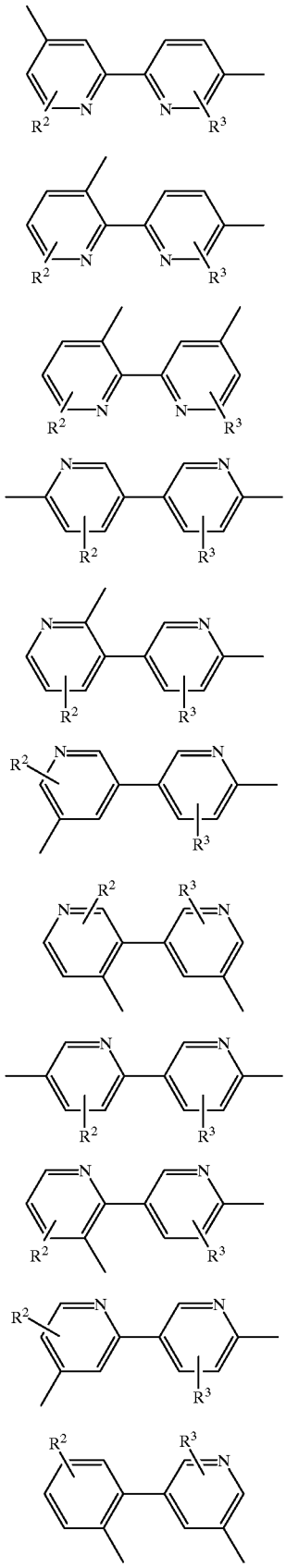
-continued
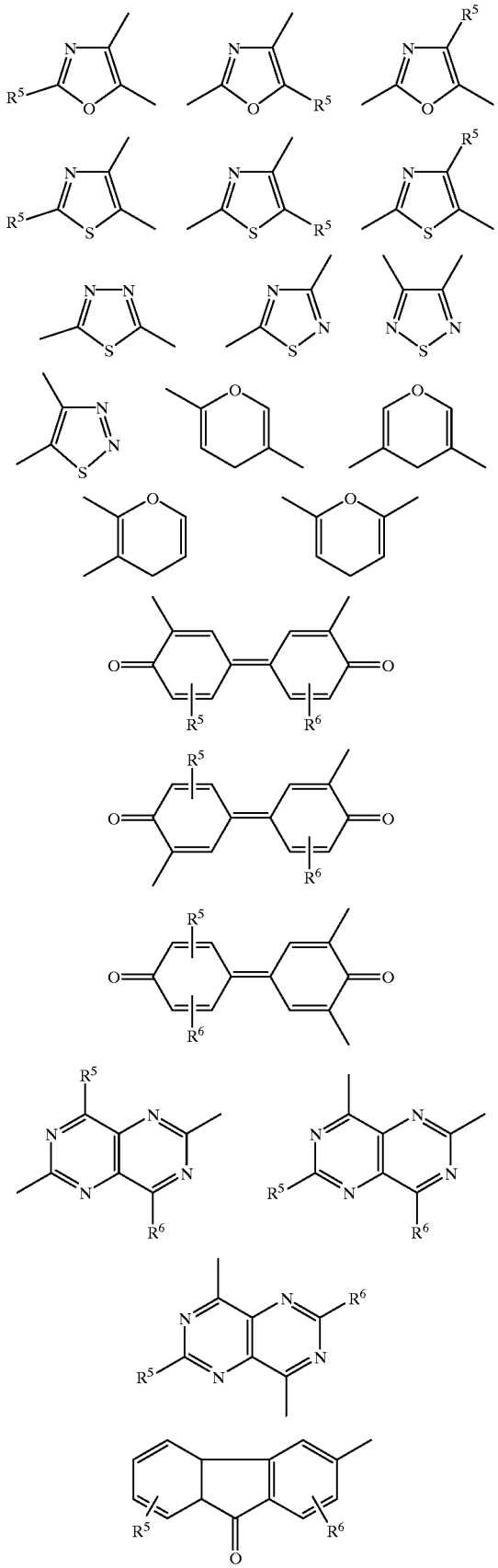

-continued

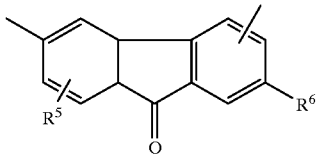

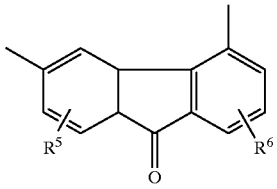

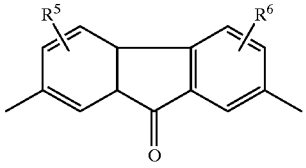

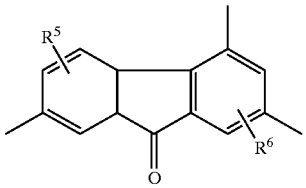

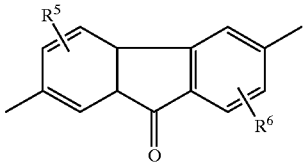

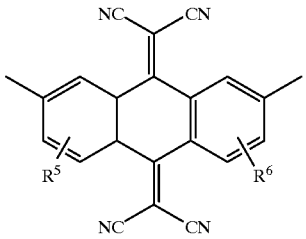

The above groups may be mutually bonded directly or through a divalent bonding group, such as —$CH_2$—, —$SiH_2$—, —O— or —S—. Of these divalent bonding groups, the hydrogen atoms of —$CH_2$— and —$SiH_2$— may each be substituted with an alkyl or aryl group.

The above $R^1$ to $R^6$ may be identical with or different from each other and individually represent a group selected from the group consisting of hydrogen and halogen atoms and cyano, alkyl, aralkyl and alkyloxy groups.

Of the above groups, it is preferred that each of X and Z represent m-phenylene, p-phenylene, 4,4'-biphenyldiyl and 2,6-pyridinediyl groups. p-Phenylene group is especially preferred.

In the production of an organic electroluminescent device having a charge injecting/transporting layer whose capability of hole injection and transport is high in conformity with the process of the second invention for producing an organic electroluminescent device, it is preferred that the organic groups X and Z be respective divalent groups derived from the following compounds:

tertiary aromatic amine and porphyrin compounds disclosed in Japanese Patent Laid-Open Publication No. 295695/1988, and aromatic tertiary amines disclosed in Japanese Patent Laid-Open Publication Nos. 27033/1978, 58445/1979, 64299/1979, 149634/1979, 144250/1980, 119132/1981 and 295558/1986.

In the formation of a charge injecting/transporting layer having especially high capability of hole injection and transport according to the above process, it is preferred that the organic groups X and Z be respective groups selected from among the following substituent group (2) or groups obtained by combining them. These groups can be formed from the compounds of the above compound group (B).

(2)

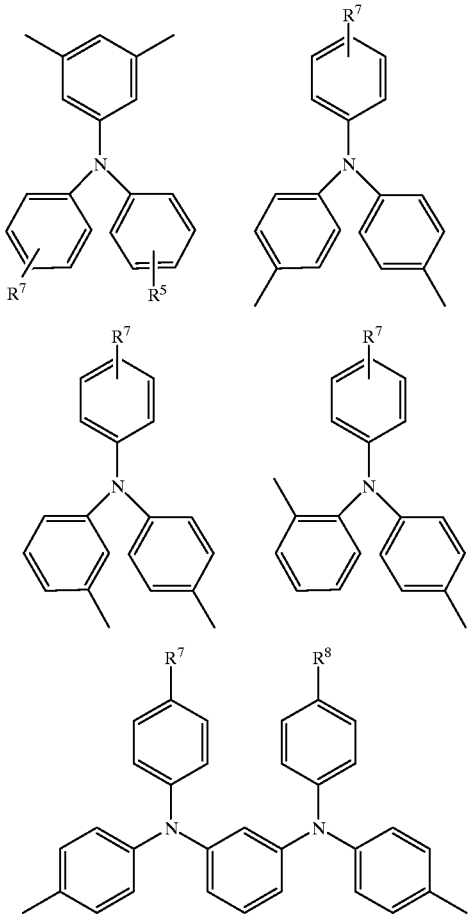

-continued
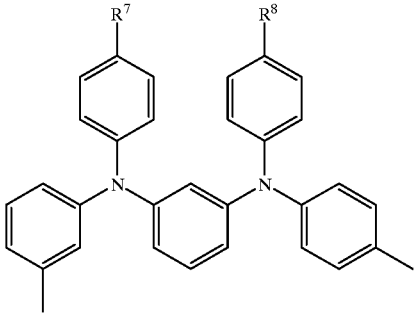
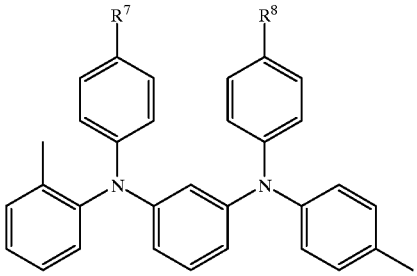
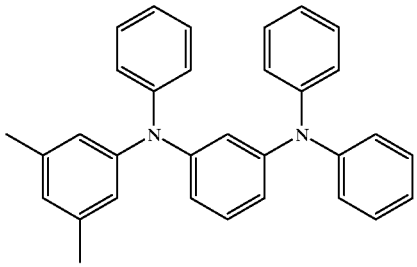
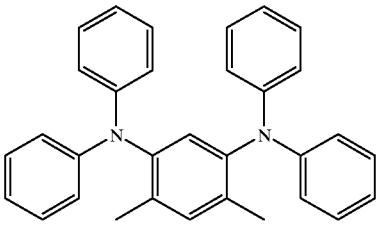
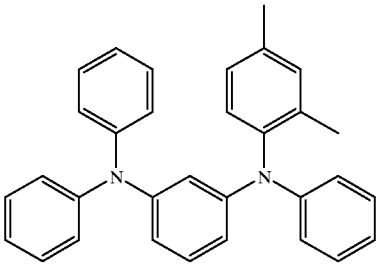
-continued
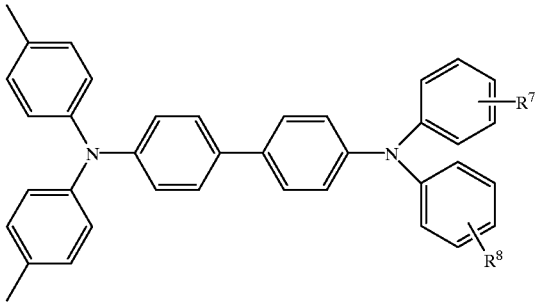
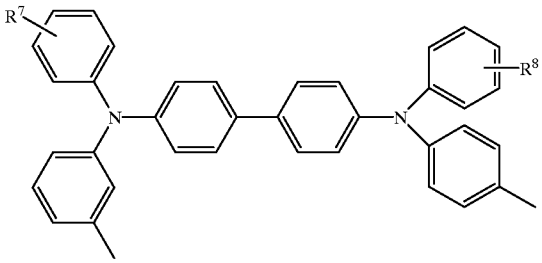
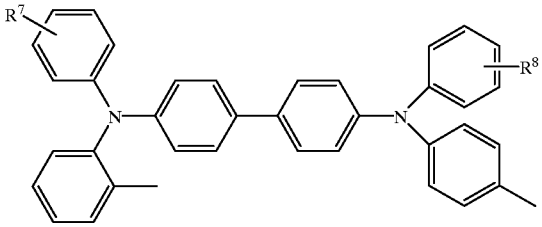
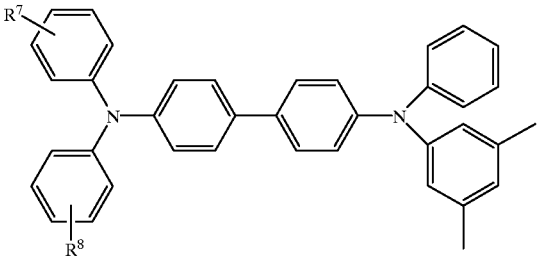
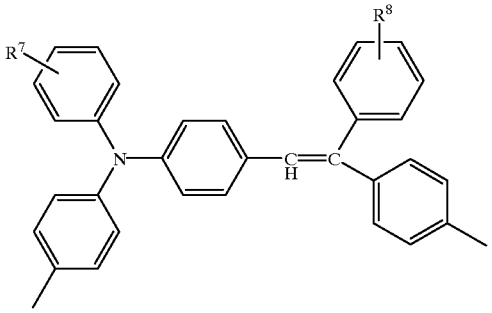

-continued
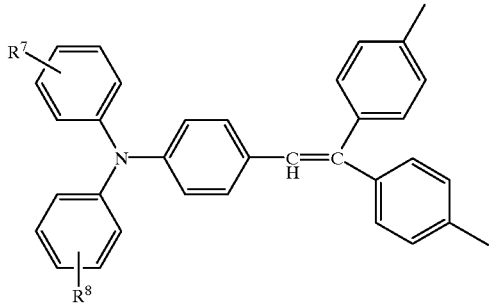
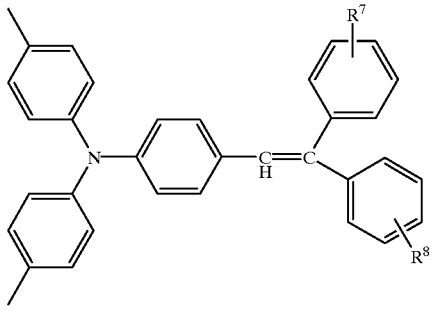
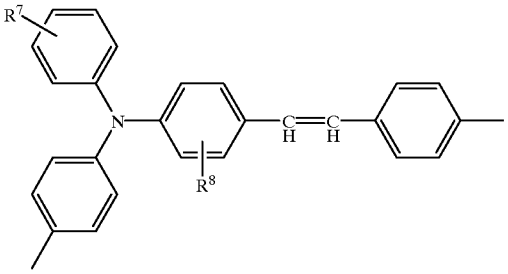
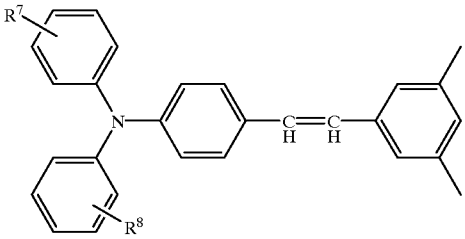
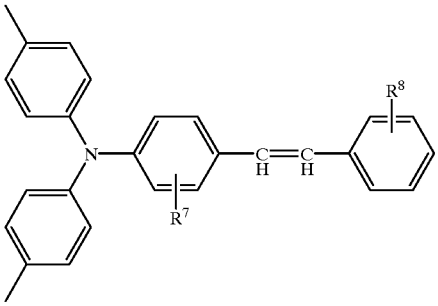
-continued
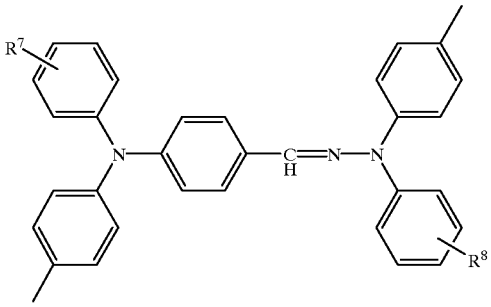
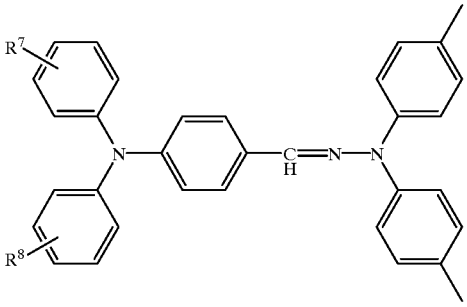
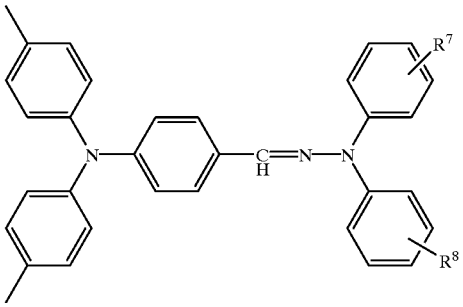
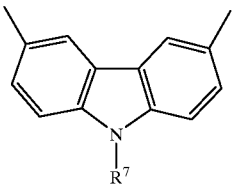
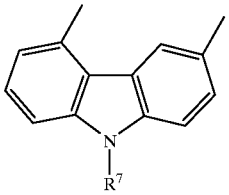
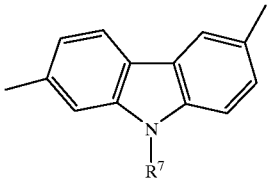

-continued

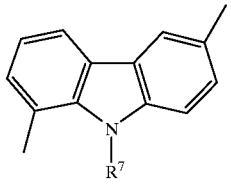

The above $R^7$ and $R^8$ may be identical with or different from each other and individually represent a group selected from the group consisting of hydrogen and halogen atoms and cyano, alkyl, aralkyl and alkyloxy groups.

In the use of a thin film of polyoxadiazoles each having a repeating unit represented by the above formula (XI) as an electroluminescent layer, preferably at least one of the above group having electron injecting and transporting properties and group having hole injecting and transporting properties is employed as the organic group X and/or Z. Illustratively stated, when the organic group X and/or Z has electron or hole injecting and transporting properties, the thin film of polyoxadiazoles each having a repeating unit represented by the above formula (XI) is excellent in electroluminescent efficiency.

For example, a thin film of polyoxadiazoles each having a repeating unit represented by the above formula (XI) which is obtained from a carboxylic acid derivative represented by the above formula (VIII) in which X is a 1,4-phenylene group and Y a chlorine atom and a trimethylsilylated dicarbohydrazide represented by the above formula (IX) in which Z is a 1,3-phenylene group and R a methyl group emits blue fluorescence having a peak at a wavelength of 410 nm. Further, when the organic groups X and Z are simultaneously 1,4-phenylene groups, the thin film of polyoxadiazoles each having a repeating unit represented by the above formula (XI) which is obtained in the same manner as above emits blue fluorescence having a peak at a wavelength of 450 nm.

In the use of the thin film of polyoxadiazoles each having a repeating unit represented by the above formula (XI) as an electroluminescent layer, a divalent group derived from conventional luminescent coloring matters employed as laser dyes or organic scintillators (luminescent coloring matter residue), for example, a luminescent coloring matter residue selected from among the following residue group (3) can be used as the organic group X and/or Z. These residues can be formed from the compounds of the above compound group (C).

(3)

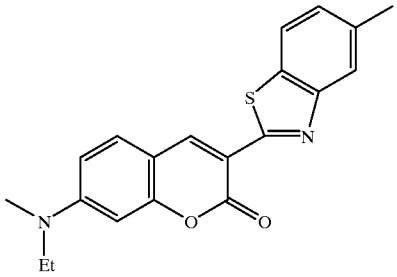

-continued

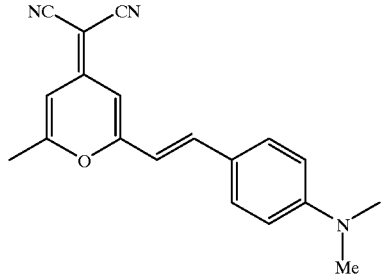

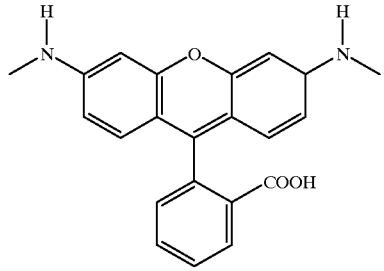

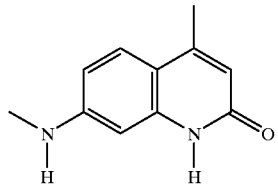

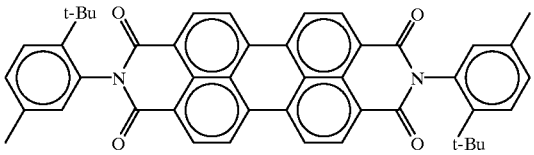

The above luminescent coloring matter residues may be used in a combination of a plurality thereof.

For making the thin film of polyoxadiazoles each having a repeating unit represented by the above formula (XI) to have ability of electroluminescence and/or ability of charge injection/transport and for accurately controlling the rate of evaporation of each of the carboxylic acid derivative represented by the above formula (VIII) and the silylated dicarbohydrazide represented by the above formula (IX) under a pressure of $10^{-2}$ to $10^{-4}$ Pa, it is preferred that the organic groups X and Z be selected from the group (4) consisting of organic groups which individually contain an alkylene group and an aromatic ring and have 2 to 50 carbon atoms. For example, the above group (4) consisting of organic groups are as illustrated below.

(4)

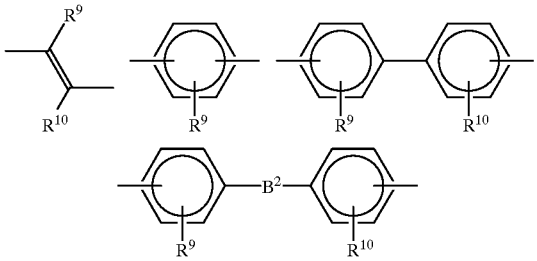

-continued

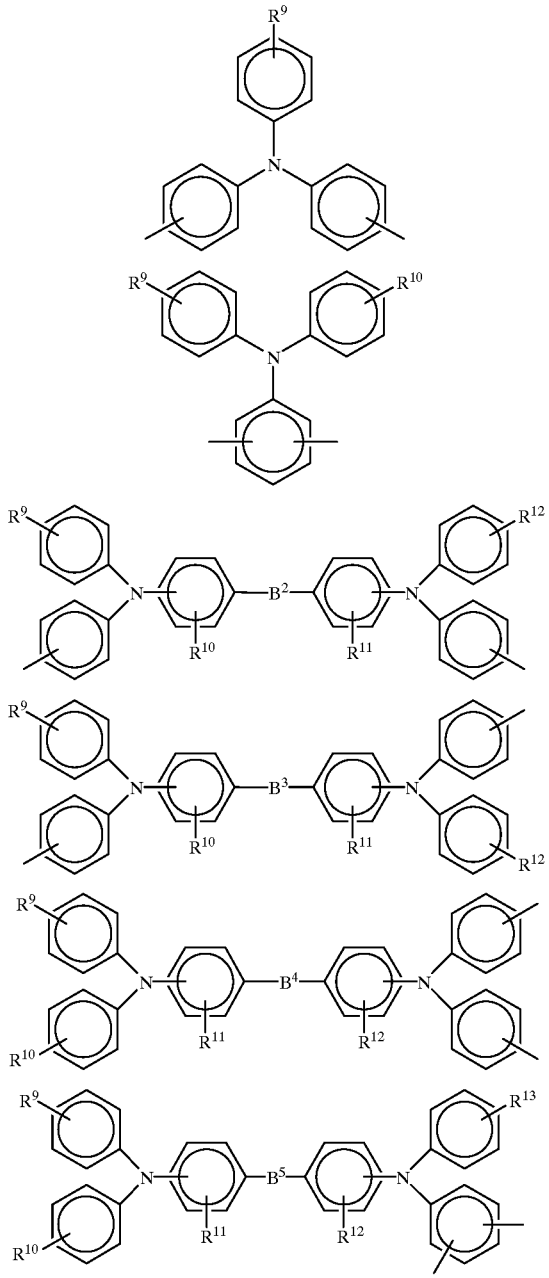

In the above formulae, $R^8$ to $R^{13}$ may be identical with or different from each other and each individually represent an unsubstituted or substituted alkyl, allyl, aryl or aralkyl group. Each of the above $B^2$ to $B^5$ independently represents —$CH_2$—, —$SiH_2$—, —O— or —S—. Of these, the hydrogen atoms of —$CH_2$— and —$SiH_2$— may each be substituted with an alkyl or aryl group.

When R of the above formula (IX) is a group selected from among methyl, ethyl, n-propyl, isopropyl, n-butyl, isobutyl, sec-butyl and phenyl groups and when z is a group selected from among the above group (4) consisting of organic groups, the vapor deposition polymerization of the silylated dicarbohydrazide represented by the above formula (IX) and the carboxylic acid derivative represented by the above formula (VIII) does not cause occurrence of acids (HCl), so that there is little danger of corroding the electrodes of the organic electroluminescent device or the body of the vapor deposition apparatus.

When Z of the above formula (IX) is a group selected from among the above group (4) consisting of organic groups, both the carboxylic acid derivative represented by the above formula (VIII) and the silylated dicarbohydrazide represented by the above formula (IX) scarcely evaporate at room temperature or below under a pressure of $10^{-2}$ to $10^{-4}$ Pa, which can be evaporated at a rate of at least $10^{-10}$ mol/cm$^2$sec at 40 to 400° C.

Therefore, the rate of evaporation of each monomer can be very accurately controlled in the vapor deposition polymerization of the above monomers conducted under a pressure falling within the above range.

In the process of the second invention for producing an organic electroluminescent device, a thin film of polymers each having a repeating unit represented by the above formula (X) can be stoichiometrically formed by regulating the molar ratio of the carboxylic acid derivative represented by the above formula (VIII) and the dicarbohydrazide represented by the above formula (IX) within the range of 1:1 to 1:30, depending on their types, and by regulating the temperature of the surface to be vapor deposited, i.e., the surface on which the thin film of polymers each having a repeating unit represented by the above formula (X) is formed within the range of −50 to 200° C. to thereby control the polymerization, depending on the molar ratio of monomers evaporated in the bell jar of the vacuum vapor deposition apparatus, the degree of vacuum of the apparatus and the temperature of the surface to be vapor deposited.

As mentioned above, heating of this thin film produces a thin film of polyoxadiazoles each having a repeating unit represented by the above formula (XI).

It is preferred that the number of repeating units represented by the above formula (X) in the polymer (polyoxadiazole precursor) and the number of repeating units represented by the above formula (XI) in the polyoxadiazole each range from 5 to 1000, especially from 10 to 500.

The polymer having a repeating unit represented by the above formula (X) is soluble in, for example, organic polar solvents such as dimethylformamide (DMF), dimethylacetamide (DMA), dimethyl sulfoxide (DMSO), N-methylpyrrolidone and pyridine. In contrast, the polyoxadiazole having a repeating unit represented by the above formula (XI) is sparingly soluble in the above customary organic solvents although it is soluble in concentrated sulfuric acid. Thus, the degree of polymerization of the polyoxadiazole having a repeating unit represented by the above formula (XI) can be estimated on the basis of that of the polycarbohydrazide having a repeating unit represented by the above formula (XI) measured with the use of the above organic solvent.

As the present applicant disclosed in Japanese Patent Application No. 5(1993)-103038, the thin film of polyoxadiazoles each having a repeating unit represented by the above formula (XI) is excellent in charge injecting efficiency, electroluminescent efficiency, heat resistance and durability, so that it is suitable for use as an electroluminescent layer or a charge injecting/transporting layer of an organic electroluminescent device.

Moreover, the formation of the thin film of polyoxadiazoles is not accompanied by the occurrence of HCl and other acids in the process of the second invention for producing an organic electroluminescent device, so that there is little danger of acid-caused corrosion of the electrodes of the organic electroluminescent device, thereby being free from the hampering by electrode corrosion of the injection of carriers from the electrode into the electroluminescent layer or the charge injecting/transporting layer. Therefore, an organic electroluminescent device which is excellent in, for example, electroluminescent efficiency can be provided.

The production of an organic electroluminescent device having an electroluminescent layer and/or a charge injecting/transporting layer formed out of a thin film of polyoxadiazoles obtained by a vapor deposition polymerization of a compound containing at least two carboxylic acid halide groups and a compound containing at least two carbohydrazide or silylated carbohydrazide groups is carried out commonly in both the processes of the first and second inventions through, for example, the following sequence of steps.

Figure 5:
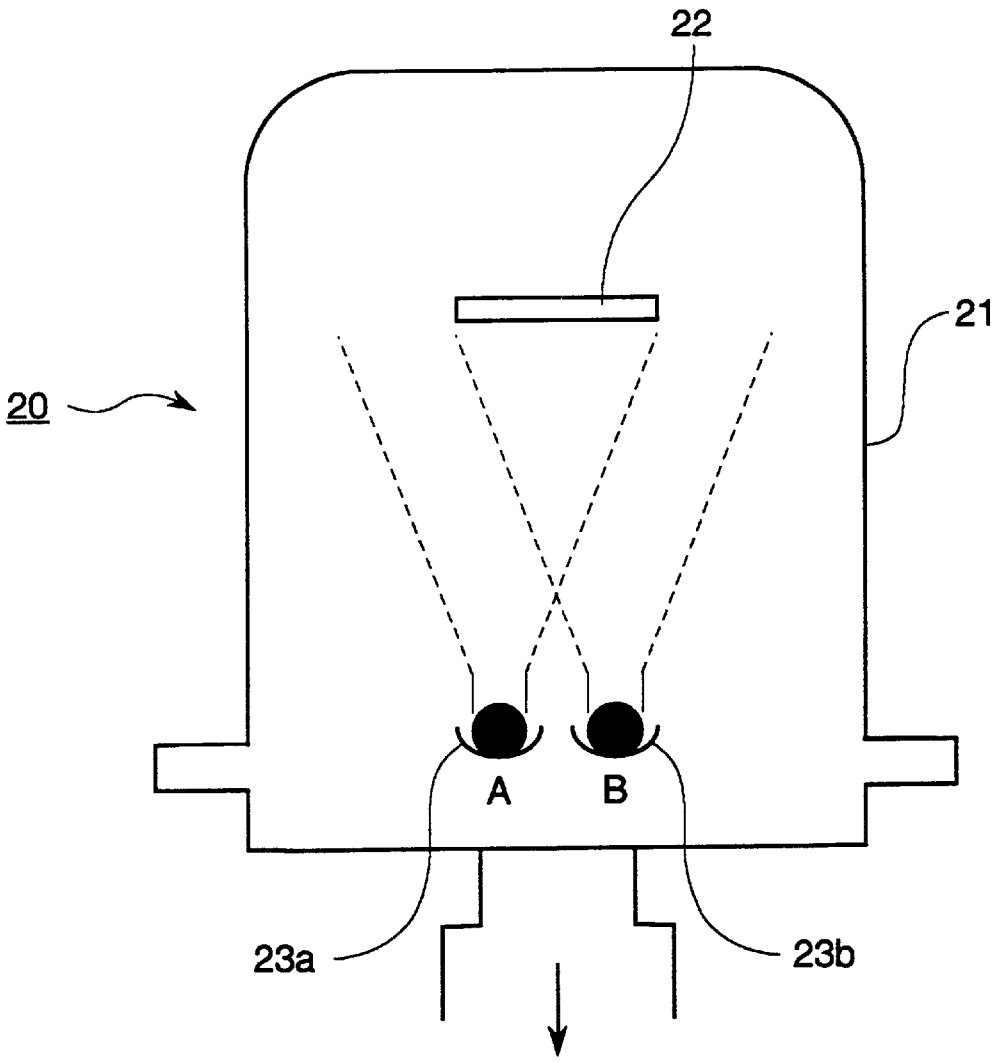
FIG. 5 is a view illustrating the process common to the first and second inventions for producing an organic thin-film electroluminescent device.

(a) First, a plate 22 to be subjected to vapor deposition, for example, a plate with an electrode of ITO is disposed in a vapor deposition chamber 21 of a vacuum vapor deposition apparatus 20 shown in FIG. 5 in an arrangement such that a vapor deposition film is formed on the ITO electrode (surface on which the vapor is deposited).

(b) Monomer A, e.g., the monomer of the above formula (I) (or the monomer of the above formula (VIII)) and monomer B, e.g., the monomer of the above formula (II) (or the monomer of the above formula (IX)) are put in separate vapor sources 23*a,* 23*b* arranged in the vacuum vapor deposition apparatus 20. When a mixture of monomer of the above formula (II) and monomer of the above formula (III) in place of the monomer of the above formula (II) is used as monomer for polymerization B, the monomer of the above formula (III) is put in a further separately installed vapor source (not shown).

(c) The inside of the vapor deposition chamber 21 is evacuated to a pressure of generally $10^{-2}$ Pa or lower, preferably $10^{-3}$ Pa or lower.

When each of the monomers of the above formulae (I) to (III) is a carbohydrazide of the above formula (VI), a vapor deposition polymerization would generate HCl, thereby corroding the electrodes and the apparatus. In contrast, when each of the monomers of the above formulae (I) to (III) is a silylated carbohydrazide of the above formula (VII), the above danger of corrosion would be relieved.

(d) During the evacuation of the inside of the vapor deposition chamber 21 to the above pressure, the temperature of the surface to be subjected to vapor deposition, e.g., the ITO electrode side of the plate with the ITO electrode is adjusted to −50 to 200° C., preferably 20 to 100° C.

(e) When the pressure of the inside of the vapor deposition chamber 21 reaches the above predetermined value, the temperatures of the vapor sources 23*a,* 23*b* and optionally the temperature of the vapor source (not shown) accommodating the monomer represented by the above formula (III) are controlled so that under the above pressure the monomers for polymerization A and B are evaporated and deposited on the target surface preferably in proportions enabling stoichiometric reaction and so that formation of a vapor deposition film (polymer) is advanced at a rate of 0.1 to 10 Å/sec, preferably 1 to 4 Å/sec. The above temperatures preferably range from about 30 to 200° C.

(f) Thus, a vapor deposition polymer film having a thickness of about 100 to 10,000 Å is formed. This vapor deposition film is heated in vacuum or an inert gas at generally 100 to 340° C., preferably 200 to 300° C. for generally 10 to 240 min, preferably 60 to 120 min. As a result, a thin film of polyoxadiazoles is formed. This heating treatment converts the carbohydrazide units (including the silylated carbohydrazide units) of the polymer obtained in the step (e) to the oxadiazole units.

The desired thin film of polyoxadiazoles is formed through the above sequence of steps. Besides, conducting a vapor deposition of a low molecular compound having ability of electron injection and transport, such as diphenoquinone and fluorenone derivatives disclosed in Chem. Mater., Vol. 13 (1991) pp. 709–714 and J. Imag. Sci., Vol. 29, No. 2 (1985) pp. 69–72, together with the above monomer A and/or B in the above step (b) results in the formation of a thin film of polyoxadiazoles containing the above low molecular compound.

EFFECT OF THE INVENTION

An organic electroluminescent device having an electroluminescent layer, and optionally charge injecting/transporting layer at least one of which are formed out of a thin film of network polymers has been provided by the first invention. The employment of the thin film of network polymers prevents the crystallization and deterioration of the organic layer which have been regarded as the problem of the prior organic electroluminescent device, thereby the first invention provides an organic electroluminescent device having excellent heat resistance and durability.

The process of the present invention for producing an organic electroluminescent device, irrespective to the first or the second invention, forms an organic layer of an organic electroluminescent device which has a low content of mixed impurities, is homogeneous and has a high heat resistance.

In the process of the second invention for producing an organic electroluminescent device, there is no danger of producing by-products of corrosive acids during the vapor deposition polymerization. Therefore, there is no danger of the corrosion of the electrode used as a substrate by the action of acids during the vapor deposition polymerization, so that the deterioration of the performance of the organic electroluminescent device caused by the corrosion of the electrode during the production thereof can be prevented beforehand. Therefore, the process of the second invention for producing an organic electroluminescent device according to the present invention provides an organic electroluminescent device which is excellent in charge injection efficiency, electroluminescent efficiency and durability such as heat resistance.

The process of the second invention for producing an organic electroluminescent device is free from the danger of generating corrosive acids as by-products during the vapor deposition polymerization as mentioned above, so that it is free from the danger of corroding the vapor deposition polymerization apparatus. Thus, it is an advantageous process for producing an organic electroluminescent device.

The process of the first invention for producing an organic electroluminescent device is free from the danger of generating corrosive acids as by-products during the vapor deposition polymerization as in the above process of the second invention, when a of the formula (I) is a carboxylic acid halide group while b of the formula (II) and c of the formula (III) are respective specific silylated carbohydrazide groups (silylated carbohydrazide group represented by the above formula (IV)) or when the above a is the specific silicated carbohydrazide group while the above b and c are respective carboxylic acid halide groups.

Hereinbelow, the present invention will be described in greater detail with reference to the following Examples, which should not be construed as limiting the scope of the invention.

EXAMPLE 1

Vapor Deposition Polymerization

A glass plate whose one side of surface is coated with ITO having a thickness of 1000 Å (manufactured by Hoya Corp.) was subjected to ultrasonic cleanings successively using plate cleaner (Semicoclean, grade EL, produced by Furuuchi Chemical Co. Ltd.), deionized water, acetone and isopropyl alcohol (IPA). From boiling isopropyl alcohol, the plate was taken out and dried.

The thus cleaned and dried ITO-coated glass plate was mounted on a temperature-controllable plate holder disposed in a vacuum vapor deposition apparatus.

Then, 2 g of N,N',O,O'-tetrakis(trimethylsilyl)-3,5-triphenylaminedicarbonyldihydrazide and 2 g of commercially available trimesic acid chloride (produced by Tokyo Kasei Kogyo Co., Ltd.) as monomers were placed in separate vapor sources in the vacuum vapor deposition apparatus.

The inside of the vacuum vapor deposition apparatus was evacuated to a pressure of $1\times10^{-3}$ Pa or below by an oil diffusion pump. Thereafter, in the beginning, a shutter disposed in front of the coated plate for isolating the coated plate from the vapor sources was closed, and, while keeping the shutter closed, the vapor sources were heated by the infrared lamp heating method. Temperatures were set so as for each of the monomers to evaporate at a rate of $10^{-8}$ to $10^{-7}$ mol/sec-cm$^2$, and the shutter in front of the coated plate was opened. Thus, the vapor deposition of the monomers on the ITO-coated plate was carried out. The molar ratio in evaporation rate of N,N',O,O'-tetrakis(trimethylsilyl)-3,5-triphenylaminedicarbonyldihydrazide to trimesic acid chloride was 3:2. When the thickness of the vapor deposition film on the coated plate reached 1000 Å as measured by a quartz resonator film thickness meter, the shutter was again closed.

The plate holder was heated to a temperature of 300° C. to thermally treat the vapor deposition film-coated plate for 1 hr. This treatment completed the polymerization of the above N,N',O,O'-tetrakis(trimethylsilyl)-3,5-triphenylaminedicarbonyldihydrazide and trimesic acid chloride.

Thus, the thin film of polyoxadiazoles was formed on the ITO-coated glass plate. A measurement by means of a surface contour meter (DEKTA K-3030 manufactured by ULVAC JAPAN) showed that the thickness of the thin film of polyoxadiazoles after the thermal treatment was 500 Å.

Confirmation of Formation of Polymeric Thin Film of Polyoxadiazoles

The same polymerization of N,N',O,O'-tetrakis(trimethylsilyl)-3,5-triphenylaminedicarbonyldihydrazide and trimesic acid chloride as above was conducted on an Al plate having a thickness of 0.5 mm to thereby form a vapor deposition film having a thickness of 1 μm, which was heated at 300° C. for 1 hr (specimen).

A FT-IR spectrum of the specimen was measured by the reflection method. The spectrum showed the disappearances of characteristic absorption at 3212 cm$^{-1}$ ascribed to a hydrazide group (N-H stretching vibration) and of absorption at 1666 cm$^{-1}$ ascribed to the C═O stretching vibration of a carbonyl group and the appearances of absorptions at 1478 and 1536 cm−1 (—C═N— and >C═C< stretching vibrations) and absorptions at 1002 and 959 cm$^{-1}$ (═C—O—C═ stretching vibration) ascribed to an oxadiazole ring to thereby ensure the formation of an oxadiazole ring. This thin film was insoluble in organic solvents. The FT-IR spectrum of the thin film obtained by the above vapor deposition polymerization agreed with that of a thin film obtained by solution polymerization.

Thus, the formation of polyoxadiazoles by the polymerization of N,N',O,O'-tetrakis(trimethylsilyl)-3,5-triphenylaminedicarbonyldihydrazide and trimesic acid chloride was confirmed.

Preparation of Electroluminescent Device and Confirmation of Electroluminescence An electrode of MgAg alloy having a weight ratio of Mg to Ag of 10/1 was formed by vapor codeposition on the thin film of polyoxadiazoles (electroluminescent layer) formed on the ITO-coated glass plate, thereby obtaining an electroluminescent device.

The thus obtained electroluminescent device corresponds to a thin-film electroluminescent device 10 as shown in FIG. 1. The ITO electrode and the MgAg electrode were electrically connected setting the former as a positive electrode 2 and the latter as a negative electrode 1, and a direct current voltage of 10 V was applied between the electrodes 1, 2. The electroluminescent device emitted bluish-green (510 μm) electroluminescence (EL).

EXAMPLE 2

Vapor Deposition Polymerization

The same cleaned ITO-coated glass plate as in Example 1 was mounted on a temperature-controllable plate holder disposed in a vacuum vapor deposition apparatus.

Then, 2 g of N,N',O,O'-tetrakis(trimethylsilyl)-trimesic acid dihydrazide and 2 g of 3,5-triphenylaminedicarbonyldichloride as monomers were placed in separate vapor sources in the vacuum vapor deposition apparatus.

The inside of the vacuum vapor deposition apparatus was evacuated to a pressure of $1\times10^{-3}$ Pa or below by an oil diffusion pump. Thereafter, in the beginning, a shutter disposed in front of the coated plate for isolating the coated plate from the vapor sources was closed, and, while keeping the shutter closed, the vapor sources were heated by the infrared lamp heating method. Temperatures were set so as for each of the monomers to evaporate at a rate of $10^{-8}$ to $10^{-7}$ mol/sec-cm$^2$, and the shutter in front of the coated plate was opened. Thus, the vapor deposition of the monomers on the ITO-coated plate was carried out. The molar ratio in evaporation rate of N,N',O,O'-tetrakis(trimethylsilyl) trimesic acid dihydrazide to 3,5-triphenylaminedicarbonyldichloride was 2:3. When the thickness of the vapor deposition film on the coated plate reached 1000 Å as measured by a quartz resonator film thickness meter, the shutter was again closed.

The plate holder was heated to a temperature of 300° C. to thermally treat the vapor deposition film-coated plate for 1 hr. This treatment completed the polymerization of the above N,N',O,O'-tetrakis(trimethylsilyl)trimesic acid dihydrazide and 3,5-triphenylaminedicarbonyldichloride.

Thus, the thin film of polyoxadiazoles (electroluminescent layer) was formed on the ITO-coated glass plate. A measurement showed that the thickness of the thin film of polyoxadiazoles after the thermal treatment was 500 Å.

Confirmation of Formation of Polymeric Thin Film of Polyoxadiazoles

The same polymerization of N,N',O,O'-tetrakis(trimethylsilyl)trimesic acid dihydrazide and 3,5-triphenylaminedicarbonyldichloride as above was conducted on an Al plate having a thickness of 0.5 μm to thereby form a vapor deposition film having a thickness of 1 μm, which was heated at 300° C. for 1 hr (specimen).

An FT-IR spectrum of the specimen was measured by the reflection method. The spectrum showed the disappearances of characteristic absorption at 3212 cm$^{-1}$ ascribed to a hydrazide group (N-H stretching vibration) and of absorption at 1666 $cm^{-1}$ ascribed to the C═O stretching vibration of a carbonyl group and the appearances of absorptions at 1478 and 1536 cm−1 (—C═N— and >C═C< sretching vibrations) and absorptions at 1002 and 959 cm−1 (═C—O—C═ sretching vibration) ascribed to an oxadiazole ring to thereby ensure the formation of an oxadiazole ring. This thin film was insoluble in organic solvents. The FT-IR spectrum of the thin film obtained by the above vapor deposition polymerization agreed with that of a thin film obtained by solution polymerization.

Thus, the formation of polyoxadiazoles by the polymerization of N,N',O,O'-tetrakis(trimethylsilyl)-trimesic acid dihydrazide and 3,5-triphenylaminedicarbonyldichloride was confirmed.

Preparation of Electroluminescent Device and Confirmation of Electroluminescence An electrode of MgAg alloy having a weight ratio of Mg to Ag of 10/1 was formed by vapor codeposition on the thin film of polyoxadiazoles formed on the ITO-coated glass plate, thereby obtaining an electroluminescent device.

The thus obtained electroluminescent device corresponds to a thin-film electroluminescent device 10 as shown in FIG. 1. The ITO electrode and the MgAg electrode were electrically connected setting the former as a positive electrode 2 and the latter as a negative electrode 1, and a direct current voltage of 10 V was applied between the electrodes 1, 2. The electroluminescent device emitted bluish-green (510 nm) electroluminescence (EL).

EXAMPLE 3

Vapor Deposition Polymerization

The same cleaned ITO-coated glass plate as in Example 1 was mounted on a temperature-controllable plate holder disposed in a vacuum vapor deposition apparatus.

Then, 2 g of N,N',O,O'-tetrakis(trimethylsilyl)-3,5-triphenylaminedicarbonyldihydrazide, 2 g of 4,4'-biphenyldicarboxylic acid dichloride and 2 g of commercially available trimesic acid chloride (produced by Tokyo Kasei Kogyo Co., Ltd.) as monomers were placed in separate vapor sources in the vacuum vapor deposition apparatus.

The inside of the vacuum vapor deposition apparatus was evacuated to a pressure of $1\times10^{-3}$ Pa or below by an oil diffusion pump. Thereafter, in the beginning, a shutter disposed in front of the coated plate for isolating the coated plate from the vapor sources was closed, and, while keeping the shutter closed, the vapor sources were heated by the infrared lamp heating method. Temperatures were set so as for N,N',O,O'-tetrakis(trimethylsilyl)-3,5-triphenylaminedicarbonyldihydrazide to evaporate at a rate of $10^{-8}$ to $10^{-7}$ mol/sec-$cm^2$ and for the sum of 4,4'-biphenyldicarboxylic acid dichloride and trimesic acid chloride to evaporate at a rate of $10^{-8}$ to $10^{-7}$ mol/sec-cm. The molar ratio in evaporation rate of N,N',O,O'-tetrakis(trimethylsilyl)-3,5-triphenylaminedicarbonyldihydrazide:4,4'-biphenyldicarboxylic acid dichloride:trimesic acid chloride was 2:1:1. Subsequently, the shutter in front of the coated plate was opened. Thus, the vapor deposition of the monomers on the ITO-coated plate was carried out. When the thickness of the vapor deposition film on the coated plate reached 1000 Å as measured by a quartz resonator film thickness meter, the shutter was again closed.

The plate holder was heated to a temperature of 300° C. to thermally treat the vapor deposition film-coated plate for 1 hr. This treatment completed the polymerization of the above N,N',O,O'-tetrakis(trimethylsilyl)-3,5-triphenylaminedicarbonyldihydrazide, 4,4'-biphenyldicarboxylic acid dichloride and trimesic acid chloride.

Thus, the thin film of polyoxadiazoles was formed on the ITO-coated glass plate. A measurement showed that the thickness of the thin film of polyoxadiazoles after the thermal treatment was 500 Å.

Confirmation of Formation of Polymeric Thin Film of Polyoxadiazoles

The same polymerization of N,N',O,O'-tetrakis(trimethylsilyl)-3,5-triphenylaminedicarbonyldihydrazide, 4,4'-biphenyldicarboxylic acid dichloride and trimesic acid chloride as above was conducted on an Al plate having a thickness of 0.5 mm to thereby form a vapor deposition film having a thickness of 1 μm, which was heated at 300° C. for 1 hr (specimen).

An FT-IR spectrum of the specimen was measured by the reflection method. The spectrum showed the disappearances of characteristic absorption at 3212 $cm^{-1}$ ascribed to a hydrazide group (N-H stretching vibration) and of absorption at 1666 $cm^{-1}$ ascribed to the C═O stretching vibration of a carbonyl group and the appearances of absorptions at 1478 and 1536 cm−1 (—C═N— and >C═C< sretching vibrations) and absorptions at 1002 and 959 $cm^{-1}$ (═C—O—C═ sretching vibration) ascribed to an oxadiazole ring to thereby ensure the formation of an oxadiazole ring. This thin film was insoluble in organic solvents. The FT-IR spectrum of the thin film obtained by the above vapor deposition polymerization agreed with that of a thin film obtained by solution polymerization.

Thus, the formation of polyoxadiazoles by the polymerization of N,N',O,O'-tetrakis(trimethylsilyl)-3,5-triphenylaminedicarbonyldihydrazide, 4,4'-biphenyldicarboxylic acid dichloride and trimesic acid chloride was confirmed.

Preparation of Electroluminescent Device and Confirmation of Electroluminescence An electrode of MgAg alloy having a weight ratio f Mg to Ag of 10/1 was formed by vapor codeposition on the thin film of polyoxadiazoles (electroluminescent layer) formed on the ITO-coated glass plate, thereby obtaining an electroluminescent device.

The thus obtained electroluminescent device corresponds to a thin-film electroluminescent device 10 as shown in FIG. 1. The ITO electrode and the MgAg electrode were electrically connected setting the former as a positive electrode 2 and the latter as a negative electrode 1, and a direct current voltage of 10 V was applied between the electrodes 1, 2. The electroluminescent device emitted bluish-green (510 nm) electroluminescence (EL).

EXAMPLE 4

Vapor Deposition Polymerization

The same cleaned ITO-coated glass plate as in Example 1 was mounted on a temperature-controllable plate holder disposed in a vacuum vapor deposition apparatus.

Then, 2 g of N,N',O,O'-tetrakis(trimethylsilyl)-3,5-triphenylaminedicarbonyldihydrazide, 2 g of N,N',O,O'-tetrakis(trimethylsilyl)-5-tert-butylisophthalic acid dihydrazide and 2 g of commercially available trimesic acid chloride (produced by Tokyo Kasei Kogyo Co., Ltd.) as monomers were placed in separate vapor sources in the vacuum vapor deposition apparatus.

The inside of the vacuum vapor deposition apparatus was evacuated to a pressure of $1\times10^{-3}$ Pa or below by an oil diffusion pump. Thereafter, in the beginning, a shutter disposed in front of the coated plate for isolating the coated plate from the vapor sources was closed, and, while keeping the shutter closed, the vapor sources were heated by the infrared lamp heating method. First, temperatures were set so as for each of N,N',O,O'-tetrakis(trimethylsilyl)-3,5-triphenylaminedicarbonyldihydrazide and trimesic acid chloride to evaporate at a rate of $10^{-8}$ to $10^{-7}$ mol/sec-cm$^2$, and the shutter in front of the coated plate was opened. Thus, the vapor deposition of the monomers on the ITO-coated plate was carried out. The molar ratio in evaporation rate of N,N',O,O'-tetrakis(trimethylsilyl)-3,5-triphenylaminedicarbonyl-dihydrazide to trimesic acid chloride was 3:2. When the thickness of the vapor deposition film on the coated plate reached 1000 Å as measured by a quartz resonator film thickness meter, the shutter was again closed.

Thereafter, temperatures were set so as for each of N,N',O,O'-tetrakis(trimethylsilyl)-5-tert-butylisophthalic acid dihydrazide and trimesic acid chloride to evaporate at a rate of $10^{-8}$ to $10^{-7}$ mol/sec-cm$^2$, and the shutter in front of the coated plate was opened. Thus, the vapor deposition of the monomers on the ITO-coated plate was carried out. The molar ratio in evaporation rate of N,N',O,O'-tetrakis (trimethylsilyl)-5-tert-butylisophthalic acid dihydrazide to trimesic acid chloride was 3:2. When the thickness of the vapor deposition film on the coated plate reached 600 Å as measured by a quartz resonator film thickness meter, the shutter was again closed.

The plate holder was heated to a temperature of 300° C. to thermally treat the vapor deposition film-coated plate for 1 hr. This treatment completed the polymerization of the above N,N',O,O'-tetrakis(trimethylsilyl)-3,5-triphenylaminedicarbonyldihydrazide and trimesic acid chloride and also the polymerization of N,N',O,O'-tetrakis (trimethylsilyl)-5-tert-butylisophthalic acid dihydrazide and trimesic acid chloride.

Thus, the thin film of two layers of polyoxadiazoles different from each other was formed on the ITO-coated glass plate. A measurement showed that the thicknesses of the two layers of the thin film of polyoxadiazoles after the thermal treatment were 500 and 300 Å, respectively.

Confirmation of Formation of Polymeric Thin Film of Two Layers of Polyoxadiazoles Different from Each Other The same polymerization of N,N',O,O'-tetrakis (trimethylsilyl)-3,5-triphenylaminedicarbonyldihydrazide and trimesic acid chloride as above was conducted on an Al plate having a thickness of 0.5 mm to thereby form a vapor deposition film having a thickness of 1 $\mu$m, which was heated at 300° C. for 1 hr (specimen). Likewise, the same polymerization of N,N',O,O'-tetrakis(trimethylsilyl)-5-tert-butylisophthalic acid dihydrazide and trimesic acid chloride as above was conducted on an Al plate having a thickness of 0.5 mm to thereby form a vapor deposition film having a thickness of 1 $\mu$m, which was heated at 300° C. for 1 hr (specimen).

A FT-IR spectrum of each of the above two specimens was measured by the reflection method. Each spectrum showed the disappearances of characteristic absorption at 3212 cm$^{-1}$ ascribed to a hydrazide group (N-H stretching vibration) and of absorption at 1666 cm$^{-1}$ ascribed to the C═O stretching vibration of a carbonyl group and the appearances of absorptions at 1478 and 1536 cm$^{-1}$ (—C═N— and >C═C< sretching vibrations) and absorptions at 1002 and 959 cm−1 (═C—O—C═ sretching vibration) ascribed to an oxadiazole ring to thereby ensure the formation of an oxadiazole ring. These thin films were insoluble in organic solvents. The FT-IR spectrum of each of the thin films obtained by the above vapor deposition polymerization agreed with that of a corresponding thin film obtained by solution polymerization.

Thus, the formation of polyoxadiazoles by the polymerization of N,N',O,O'-tetrakis(trimethylsilyl)-3,5-triphenylaminedicarbonyldihydrazide and trimesic acid chloride and the formation of polyoxadiazoles by the polymerization of N,N',O,O'-tetrakis(trimethylsilyl)-5-tert-butylisophthalic acid dihydrazide and trimesic acid chloride were confirmed.

Preparation of Electroluminescent Device and Confirmation of Electroluminescence An electrode of MgAg alloy having a weight ratio of Mg to Ag of 10/1 was formed by vapor codeposition on the thin film of two layers of polyoxadiazoles different from each other (electroluminescent layers) superimposed on the ITO-coated glass plate, thereby obtaining an electroluminescent device.

The thus obtained electroluminescent device corresponds to a thin-film electroluminescent device 10 as shown in FIG. 3. The ITO electrode and the MgAg electrode were electrically connected setting the former as a positive electrode 2 and the latter as a negative electrode 1, and a direct current voltage of 15 V was applied between the electrodes 1, 2. The electroluminescent device emitted bluish-green (510 nm) electroluminescence (EL).

EXAMPLE 5

Vapor Deposition Polymerization

A glass plate whose one side of surface is coated with ITO having a thickness of 1000 Å (manufactured by Hoya Corp.) was subjected to ultrasonic cleanings successively using acetone, deionized water, plate cleaner (Semicoclean, grade EL, produced by Furuuchi Chemical Co., Ltd.), deionized water and isopropyl alcohol (IPA). From boiling IPA, the plate was taken out and dried. This plate was mounted on a temperature-controllable plate holder disposed in a vacuum vapor deposition apparatus.

Then, monomers for vapor deposition polymerization, i.e., trimethylsilylated dicarbohydrazide monomer represented by the following formula [N,O-tetrakis (trimethylsilyl)terephthalic acid hydrazide]:

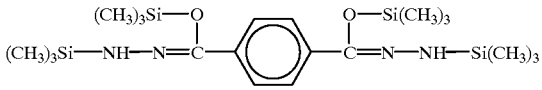

and 5-diphenylamino-isophthalic acid chloride were placed in separate vessels 23*a*, 23*b* in the vacuum vapor deposition apparatus shown in FIG. 1.

The inside of the vacuum vapor deposition apparatus was evacuated to a pressure of $1\times10^{-4}$ Pa or below by an oil diffusion pump. Thereafter, in the beginning, a shutter disposed in front of the coated plate was closed, and, while keeping the shutter closed, the vessels were heated by the resistance or infrared lamp heating method. Vapor source temperatures were set so as for each of the monomers to evaporate at a rate of $10^{-7}$ mol/cm$^2$-sec, and the shutter in front of the coated plate was opened. When the thickness of a vapor deposition film on the coated plate reached 800 Å as measured by a quartz resonator film thickness meter, the shutter was closed. The plate holder was heated to a temperature of 300° C. to thermally treat the vapor deposition film-coated plate for 30 min.

The above procedure was repeated on two Al plates each having a thickness of 0.5 mm to thereby obtain two specimens each comprising the above plate and, formed thereon, a vapor deposition film having a thickness of 1 $\mu$m. One of the specimens was heated at 300° C.

An FT-IR spectrum of each of the above specimens was measured by the reflection method. The IR spectrum of the specimen which had not undergone the thermal treatment showed absorptions at 3250 $cm^{-1}$ (N-H stretching vibration) and 1651 $cm^{-1}$ (C═O stretching vibration) ascribed to an amide bond. Further, Si—C stretching vibration ascribed to an O—Si(CH3)3 group was observed at 1248 and 843 $cm^{-1}$. From these, the formation of polyoxadiazole precursor was confirmed. In the IR spectrum of the specimen which had undergone the thermal treatment, the above absorptions disappeared. New absorption peak (corresponding to aromatic sretching and —C═N— sretching of oxadiazole ring) ascribed to an oxadiazole ring was observed at 1545 cm−1, so that the formation of an oxadiazole ring was confirmed.

Preparation of Organic Electroluminescent Device and Confirmation of Electroluminescence Thereof An electrode of MgAg alloy having a weight ratio of Mg to Ag of 10/1 was formed by codeposition on the electroluminescent layer formed on the glass plate.

The ITO electrode and the MgAg electrode were electrically connected setting the former as a positive electrode and the latter as a negative electrode, and a direct current voltage of 7 V was applied between the electrodes. The electroluminescent device emitted bluish-green electroluminescence having a peak at a wavelength of 510 nm.

EXAMPLE 6

A thin film of polyoxadiazoles having a thickness of 500 Å was prepared by vapor deposition polymerization in the same manner as in Example 5. Subsequently, an electron-transporting electroluminescent layer of tris(8-quinolinol) aluminum having a thickness of 300 Å was formed by vapor deposition, on which Mg and Ag were vapor codeposited to provide a negative electrode. In the resultant device, the ITO electrode and the MgAg electrode were electrically connected setting the former as a positive electrode and the latter as a negative electrode, and a direct current voltage of at least 5 V was applied between the electrodes. The electroluminescent device emitted green electroluminescence.

What is claimed is:

1. An organic thin-film electroluminescent device comprising:

electrodes, at least one of the electrodes being transparent; and interposed between said electrodes, at least one layer selected from the group consisting of an electroluminescent layer, a charge injecting/transporting layer and a layer capable of electroluminescence and charge injection/transportation, said at least one layer formed out of a thin film of network polymers having a network structure and obtained by a vapor deposition polymerization process, wherein the thin film is composed of polymers each having oxadiazole units.

2. The organic thin-film electroluminescent device as claimed in claim 1, which is prepared by a process which comprises:

providing monomer A consisting of a bifunctional monomer represented by the following formula (I) and monomer B consisting of a polyfunctional monomer represented by the following formula (II) or a mixture of the polyfunctional monomer and a bifunctional monomer represented by the following formula (III):

(I)

$$R^1—(a)_2$$

(II)

$$R^2—(b)_m$$

(III)

$$R^3—(c)_2$$

wherein:

m is an integer of 3 or greater, each of $R^1$ and $R^3$ may be the same or different from each other and independently represents a divalent organic group, $R^2$ represents an m-valent organic group, provided that m is an integer of 3 or greater, a represents a group selected from a carboxylic acid halide group, a carbohydrazide group and a silylated carbohydrazide group represented by the following formula:

(IV)

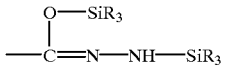

wherein R represents an alkyl or aryl group having not more than 6 carbon atoms, provided that, when a is a carboxylic acid halide group, each of b and c is a carbohydrazide group or a silylated carbohydrazide group represented by the above formula (IV) and that, when a is a carbohydrazide group or a silylated carbohydrazide group represented by the above formula (IV), b and c are respective carboxylic acid halide;

evaporating the monomers A and B from respective separate vapor sources in vacuum so that a thin film of polyoxadiazole precursors is formed between electrodes, at least one of which is transparent; and heating the thin film at 100 to 400° C. in vacuum or an inert gas, thereby converting the polyoxadiazole precursors to polyoxadiazoles so that an electroluminescent layer and/or a charge injecting/transporting layer is formed out of the thin film of the polyoxadiazoles.

3. The organic thin-film electroluminescent device as claimed in claim 2, wherein at least one of the groups represented by $R^1$, $R^2$ and $R^3$ is a group derived from an aromatic tertiary amine or an aromatic tertiary diamine.

4. The organic thin-film electroluminescent device as claimed in claim 1, which is prepared by a process which comprises:

subjecting a carboxylic acid derivative represented by the following formula:

(VIII)

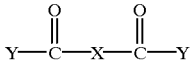

wherein X represents a divalent organic group and Y represents a halogen atom; and a silylated dicarbohydrazide represented by the formula:

(IX)

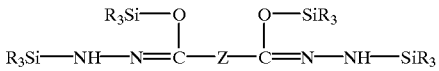

wherein Z represents a divalent organic group and R represents an alkyl or aryl group having not more than 6 carbon atoms, to a vapor deposition polymerization on a surface to be vapor deposited, thereby forming a thin film of polymers each having a repeating unit represented by the formula:

(X)

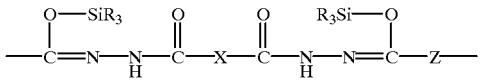

wherein X, Z and R are as defined above; and heating the thin film at 100 to 400° C. in vacuum or an inert gas, thereby forming an electroluminescent layer and/or a charge injecting/transporting layer composed of a thin film of polyoxadiazoles each having a repeating unit represented by the formula:

(XI)

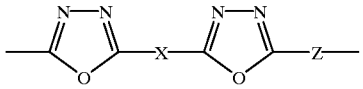

wherein X and Z are as defined above.

5. The organic thin-film electroluminescent device as claimed in claim 4, wherein the vapor deposition polymerization is performed using the carboxylic acid derivative and the silylated dicarbohydrazide in a molar ratio of 1:1 to 1:30 and wherein the temperature of the surface on which the thin film of the polymers each having the repeating unit represented by the above formula (X) is formed by the vapor deposition polymerization ranges from −50 to 200° C.

6. The organic thin-film electroluminescent device as claimed in claim 4, wherein the vapor deposition polymerization of the carboxylic acid derivative and the silylated dicarbohydrazide is performed at a pressure of $10^{-2}$ to $10^{-4}$ Pa under which the carboxylic acid derivative and the silylated dicarbohydrazide are each evaporated at a rate of at least $10^{-10}$ mol/cm$^2$.sec at 40 to 400° C.

7. The organic thin-film electroluminescent device as claimed in claim 4, wherein the R of the formula (IX) represents a group selected from the group consisting of methyl, ethyl, n-propyl, iso-propyl, n-butyl, isobutyl, sec-butyl and phenyl groups.

8. The organic thin-film electroluminescent device as claimed in claim 4, wherein each of X and Z represents an organic group containing an aromatic ring or an alkylene group having 2 to 50 carbon atoms which contain conjugated π-electrons.

9. The organic thin-film electroluminescent device as claimed in claim 8, wherein each of X and Z represents any of a vinylene group, a phenylene group, a biphenylene group and a divalent group derived from triphenylamine, each unsubstituted or substituted with a group selected form the group consisting of alkyl, allyl, aryl and aralkyl groups.

10. The organic thin-film electroluminescent device as claimed in claim 4, wherein the number of repeating units represented by (X) in polymer and the number of repeating units represented by (XI) in the polyoxadiazole each range from 5 to 1000.

11. The organic thin-film electroluminescent device as claimed in claim 1, wherein a first of said electrodes is formed of Mg, Ag, In, Ca or Al as the negative electrode, and a second of said electrodes is formed of indium tin oxide or gold as the positive electrode.

12. The organic thin-film electroluminescent device as claimed in claim 1, wherein said electroluminescent layer has a thickness of 100 to 2000 Å.

13. A process of preparing the organic thin-film electroluminescent device of claim 1, the process comprising:

providing monomer A consisting of a bifunctional monomer represented by the following formula (I) and monomer B consisting of a polyfunctional monomer represented by the following formula (II) or a mixture of the polyfunctional monomer and a bifunctional monomer represented by the following formula (III):

(I)

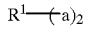

(II)

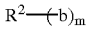

(III)

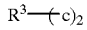

wherein:

m is an integer of 3 or greater, each of $R^1$ and $R^3$ may be the same or different from each other and independently represents a divalent organic group, $R^2$ represents an m-valent organic group, provided that m is an integer of 3 or greater, a represents a group selected from a carboxylic acid halide group, a carbohydrazide group and a silylated carbohydrazide group represented by the following formula:

(IV)

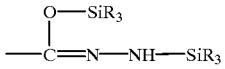

wherein R represents an alkyl or aryl group having not more than 6 carbon atoms, provided that, when a is a carboxylic acid halide group, each of b and c is a carbohydrazide group or a silylated carbohydrazide group represented by the above formula (IV) and that, when a is a carbohydrazide group or a silylated carbohydrazide group represented by the above formula (IV), b and c are respective carboxylic acid halide;

evaporating the monomers A and B from respective separate vapor sources in vacuum so that a thin film of polyoxadiazole precursors is formed between electrodes, at least one of which is transparent; and heating the thin film at 100 to 400° C. in vacuum or an inert gas, thereby converting the polyoxadiazole precursors to polyoxadiazoles so that an electroluminescent layer and/or a charge injecting/transporting layer is formed out of the thin film of the polyoxadiazoles.

14. The process as claimed in claim 13, wherein at least one of the groups represented by $R^1$, $R^2$ and $R^3$ is a group derived from an aromatic tertiary amine or an aromatic tertiary diamine.

15. A process for preparing the organic thin-film electroluminescent device of claim 1, the process comprising:

subjecting a carboxylic acid derivative represented by the following formula:

(VIII)

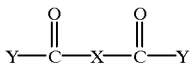

wherein X represents a divalent organic group and Y represents a halogen atom; and a silylated dicarbohydrazide represented by the formula:

(IX)

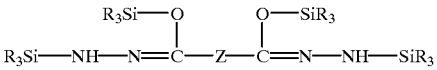

wherein Z represents a divalent organic group and R represents an alkyl or aryl group having not more than 6 carbon atoms, to a vapor deposition polymerization on a surface to be vapor deposited, thereby forming a thin film of polymers each having a repeating unit represented by the formula:

(X)

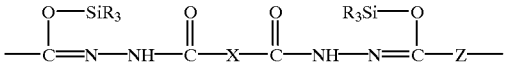

wherein X, Z and R are as defined above; and heating the thin film at 100 to 400° C. in vacuum or an inert gas, thereby forming an electroluminescent layer and/or a charge injecting/transporting layer composed of a thin film of polyoxadiazoles each having a repeating unit represented by the formula:

(XI)

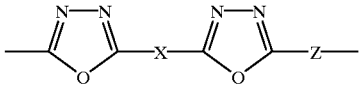

wherein X and Z are as defined above.

16. The process as claimed in claim 15, wherein the vapor deposition polymerization is performed using the carboxylic acid derivative and the silylated dicarbohydrazide in a molar ratio of 1:1 to 1:30 and wherein the temperature of the surface on which the thin film of the polymers each having the repeating unit represented by the above formula (X) is formed by the vapor deposition polymerization ranges from −50 to 200° C.

17. The process as claimed in claim 15, wherein the vapor deposition polymerization of the carboxylic acid derivative and the silylated dicarbohydrazide is performed at a pressure of $10^{-2}$ to $10^{-4}$ Pa under which the carboxylic acid derivative and the silylated dicarbohydrazide are each evaporated at a rate of at least $10^{-10}$ mol/cm$^2$.sec at 40 to 400° C.

18. The process as claimed in claim 15, wherein the R of the formula (IX) represents a group selected from the group consisting of methyl, ethyl, n-propyl, iso-propyl, n-butyl, isobutyl, sec-butyl and phenyl groups.

19. The process as claimed in claim 15, wherein each of X and Z represents an organic group containing an aromatic ring or an alkylene group having 2 to 50 carbon atoms which contain conjugated π-electrons.

20. The process as claimed in claim 19, wherein each of X and Z represents any of a vinylene group, a phenylene group, a biphenylene group and a divalent group derived from triphenylamine, each unsubstituted or substituted with a group selected form the group consisting of alkyl, allyl, aryl and aralkyl groups.

* * * * *